US008663462B2

(12) United States Patent
Duyvesteyn

(10) Patent No.: US 8,663,462 B2
(45) Date of Patent: Mar. 4, 2014

(54) METHODS FOR OBTAINING BITUMEN FROM BITUMINOUS MATERIALS

(75) Inventor: Willem P. C. Duyvesteyn, Reno, NV (US)

(73) Assignee: Shell Canada Energy Cheveron Canada Limited, Calgary (CA)

( * ) Notice: Subject to any disclaimer, the term of this patent is extended or adjusted under 35 U.S.C. 154(b) by 203 days.

(21) Appl. No.: 12/560,964

(22) Filed: Sep. 16, 2009

(65) Prior Publication Data

US 2011/0062057 A1 Mar. 17, 2011

(51) Int. Cl.
*C10G 1/04* (2006.01)

(52) U.S. Cl.
USPC ..... 208/428; 208/390; 208/429; 208/434; 208/435

(58) Field of Classification Search
USPC ..... 208/11 LE, 390, 391, 428–429, 208/434–435; 422/187, 255
See application file for complete search history.

(56) References Cited

U.S. PATENT DOCUMENTS 2,808,431 A * 10/1957 Fierce ..... 562/511
2,871,180 A 1/1959 Lowman
3,131,141 A 4/1964 West
3,484,365 A 12/1969 Pitchford
3,527,692 A 9/1970 Titus
3,565,593 A 2/1971 Moore et al.
3,565,594 A 2/1971 Moore
3,779,902 A 12/1973 Mitchell et al.
4,035,282 A 7/1977 Stuchberry et al.
4,046,668 A 9/1977 Farcasiu et al.
4,054,506 A 10/1977 Hart, Jr. et al.
4,120,773 A 10/1978 Ridgway
4,120,777 A 10/1978 Globus
4,139,450 A 2/1979 Hanson et al.
4,222,873 A * 9/1980 Parsons ..... 210/777
4,224,138 A 9/1980 Kruyer (Continued)

FOREIGN PATENT DOCUMENTS

CA 2224615 6/1999
WO WO 01/32936 5/2001

(Continued)

OTHER PUBLICATIONS

Sinnott, R. K. (2005). Chemical Engineering Design, 4th ed., Elsevier, 1038 pgs.*

(Continued)

*Primary Examiner* — Brian McCaig

(57) ABSTRACT

Methods for extracting bitumen from bituminous material through the use of a polar solvent. The method may include a primary leaching or extraction process that separates most of the bitumen from a material comprising bitumen and produces first solvent-wet tailings. A polar solvent is added to the first solvent-wet tailings in order to remove the first solvent (plus any entrained bitumen) from the tailings. A mixture of polar solvent and first solvent produced by the addition of the polar solvent to the first solvent-wet tailings may be phase separated by maintaining the polar solvent-first solvent mixture for a period of time. Alternatively, the polar solvent and first solvent may leave the tailings in a phase separated state. Phase separation may occur due to the presence of water in the polar solvent-first solvent mixture. Water may also be added to the mixture of solvents to serve as an antisolvent and initiate phase separation. The separated solvents may then be recovered and reused in the method.

34 Claims, 3 Drawing Sheets

(56) References Cited

U.S. PATENT DOCUMENTS

| | | | | |
|---|---|---|---|---|
| 4,250,016 | A | 2/1981 | Estes et al. | |
| 4,308,133 | A | 12/1981 | Meyer | |
| 4,347,118 | A | 8/1982 | Funk et al. | |
| 4,490,259 | A | 12/1984 | Coffing | |
| 4,512,872 | A | 4/1985 | Chung et al. | |
| 4,589,980 | A | 5/1986 | Keys | |
| 4,592,826 | A | 6/1986 | Ganguli | |
| 4,596,651 | A | 6/1986 | Wolff et al. | |
| 4,612,113 | A | 9/1986 | Kallioinen | |
| 4,676,889 | A | 6/1987 | Hsieh et al. | |
| 4,678,561 | A | 7/1987 | Keys | |
| 4,678,562 | A | 7/1987 | Keys | |
| 4,702,487 | A | 10/1987 | Stoian et al. | |
| 4,722,782 | A | 2/1988 | Graham et al. | |
| 4,724,272 | A | 2/1988 | Raniere et al. | |
| 4,744,890 | A | 5/1988 | Miller et al. | |
| 4,846,964 | A | 7/1989 | Scott et al. | |
| 4,859,317 | A | 8/1989 | Shelfantook et al. | |
| 5,044,552 | A | 9/1991 | Becker et al. | |
| 5,084,160 | A | 1/1992 | Stewart et al. | |
| 5,143,598 | A | 9/1992 | Graham et al. | |
| 5,176,802 | A | 1/1993 | Duyvesteyn et al. | |
| 5,223,148 | A | 6/1993 | Tipman et al. | |
| 5,236,577 | A | 8/1993 | Tipman et al. | |
| 5,295,665 | A | 3/1994 | Mackie | |
| 5,389,274 | A | 2/1995 | Fernandez | |
| 5,443,158 | A | 8/1995 | McKenny et al. | |
| 5,485,883 | A | 1/1996 | Rippetoe et al. | |
| 5,520,799 | A | 5/1996 | Brown et al. | |
| 5,534,136 | A | 7/1996 | Rosenbloom | |
| 5,538,081 | A | 7/1996 | Rippetoe et al. | |
| 5,554,301 | A | 9/1996 | Rippetoe et al. | |
| 5,626,743 | A | 5/1997 | Humphreys | |
| 5,626,793 | A | 5/1997 | Reiffenrath et al. | |
| 5,670,056 | A | 9/1997 | Yoon et al. | |
| 5,670,345 | A | 9/1997 | Srivastava et al. | |
| 5,702,612 | A | 12/1997 | Wang | |
| 5,728,202 | A | 3/1998 | Nelson et al. | |
| 5,795,466 | A | 8/1998 | Kelebek et al. | |
| 5,798,137 | A | 8/1998 | Lord et al. | |
| 5,849,201 | A | 12/1998 | Bradley | |
| 5,872,289 | A | 2/1999 | Appleby et al. | |
| 5,876,592 | A | 3/1999 | Tipman et al. | |
| 5,896,435 | A | 4/1999 | Gautier et al. | |
| 5,961,786 | A | 10/1999 | Freel et al. | |
| 5,968,349 | A | 10/1999 | Duyvesteyn et al. | |
| 5,992,050 | A | 11/1999 | Kemper et al. | |
| 6,007,709 | A | 12/1999 | Duyvesteyn et al. | |
| 6,036,849 | A | 3/2000 | Rippetoe et al. | |
| 6,074,558 | A | 6/2000 | Duyvesteyn et al. | |
| 6,096,920 | A * | 8/2000 | Allen et al. | 562/406 |
| 6,106,787 | A | 8/2000 | Rippetoe | |
| 6,214,213 | B1 | 4/2001 | Tipman et al. | |
| 6,320,148 | B1 | 11/2001 | Yoon et al. | |
| 6,352,639 | B2 | 3/2002 | Ito et al. | |
| 6,427,843 | B1 | 8/2002 | Clark | |
| 6,514,310 | B2 | 2/2003 | Allemand et al. | |
| 6,589,417 | B2 | 7/2003 | Taciuk et al. | |
| 6,595,163 | B2 | 7/2003 | Dumaz et al. | |
| 6,764,542 | B1 | 7/2004 | Lackey et al. | |
| 6,768,015 | B1 | 7/2004 | Luxem et al. | |
| 6,793,079 | B2 | 9/2004 | Khan et al. | |
| 6,822,105 | B1 | 11/2004 | Luxem et al. | |
| 6,827,786 | B2 | 12/2004 | Lord | |
| 6,827,841 | B2 | 12/2004 | Kiser et al. | |
| 6,871,743 | B2 | 3/2005 | Yoon et al. | |
| 6,936,227 | B1 | 8/2005 | De Souze et al. | |
| 6,965,044 | B1 | 11/2005 | Hammond et al. | |
| 6,989,091 | B2 | 1/2006 | Jorgensen | |
| 7,011,749 | B2 | 3/2006 | Hayes et al. | |
| 7,018,435 | B1 | 3/2006 | Wentinck | |
| 7,097,675 | B2 | 8/2006 | Detering et al. | |
| 7,438,807 | B2 | 10/2008 | Garner et al. | |
| 7,464,756 | B2 | 12/2008 | Gates et al. | |
| 7,588,682 | B2 | 9/2009 | Norman | |
| 2002/0134704 | A1 | 9/2002 | Mitchell et al. | |
| 2005/0070218 | A1 | 3/2005 | Phillips et al. | |
| 2005/0092682 | A1 | 5/2005 | Phillips et al. | |
| 2006/0076274 | A1 | 4/2006 | Duyvesteyn et al. | |
| 2006/0144760 | A1 | 7/2006 | Duyvesteyn et al. | |
| 2007/0170095 | A1 | 7/2007 | Freel et al. | |
| 2007/0209971 | A1 | 9/2007 | Duyvesteyn et al. | |
| 2007/0284283 | A1 | 12/2007 | Duyvesteyn et al. | |
| 2008/0060257 | A1 | 3/2008 | Duyvesteyn | |
| 2008/0156702 | A1 | 7/2008 | Duyvesteyn | |
| 2008/0210602 | A1 * | 9/2008 | Duyvesteyn | 208/390 |
| 2008/0242875 | A1 | 10/2008 | Hong et al. | |
| 2009/0090654 | A1 | 4/2009 | Duyvesteyn et al. | |
| 2009/0145809 | A1 | 6/2009 | Ledbetter, Jr. et al. | |
| 2009/0294332 | A1 | 12/2009 | Ryu | |
| 2012/0152809 | A1 * | 6/2012 | Kift et al. | 208/390 |

FOREIGN PATENT DOCUMENTS

| | | |
|---|---|---|
| WO | WO 03/072506 | 9/2003 |
| WO | WO 2007/102819 | 9/2007 |
| WO | WO 2011/082209 | 7/2011 |

OTHER PUBLICATIONS

Knovel Critical Tables, 2nd ed. (2008).*

International Search Report from International Application No. PCT/US2006/08263.

International Search Report from International Application No. PCT/US2005/36728.

Hong, P.K. Andrew, et al., "A Polar-Nonpolar, Acetic Acid/Heptane, Solvent Medium for Degradation of Pyrene by Ozone", Ind. Eng. Chem. Res. 2004, vol. 43, pp. 7710-7715.

Biodiesel Processing, Mar. 22, 2004 (3 pp.).

Biodiesel Processing, biodiesel Handout for 2005 New Hampshire Science Tearher's Association Workshop UNH Biodiesel Group, http://www.unh.edu/p2/biodiesel, 2005 (27 pp.).

Campbell, National Biodiesel Board 2005 Annual Meeting, Marina Marriott, Ft. Lauderdale, FL, Feb. 1, 2005 (9 pp.).

Cohen et al., "Degradation of Coal by Fungi Polyporus Versicolor and Poria Monticola," Appl. Enviorn. Microbiol., 44(1):23-27, Jul. 1982 (5 pp.).

Desolventizer-Toaster, Crown Iron Works Company, PDF file created Feb. 16, 2010, (3 pp.).

Gallmetzer et al., "Efflux of Organic Acids in Penicillium Simplicissimum is an Energy-Spilling Porcess . . .," Microbiology 148:1143-1149, 2002 (7 pp.).

Houdaille, "Jet Pump Techinical Data—Puming Liquids," pp. 1-11, 1982 (12 pp.).

Information about Related Patents and Patent Applications, see the section below having the same title.

International Search Report, PCT/US10/43822, Nov. 29, 2010 (4 pp.).

International Search Report, PCT/US10/43082, Sep. 14, 2010 (11 pp.).

International Search Report and Written Opinion, PCT/US09/35552, Apr. 17, 2009 (8 pp.).

International Search Report and Written Opinion, PCT/US07/19222, Apr. 28, 2008 (8 pp.).

International Search Report, PCT/US2005/34092, Jul. 26, 2007 (6 pp.).

Lewis, "Liquefied Petroleum Gas," Hawley's condensed Chemical Dictionary (14th Edition), John Wiley Sons. , 2002 (1 p.).

Rogoff et al., "The Microbiology of Coal," Bureau of Mines, U.S. Dept. of the Interior, Region V, Bruceton, PA, 73:264-268, Aug. 23, 1956 (5 pp.).

Soygold, Environmental Solutions to Your Market Challenges, http://www.soygold.com/applications.htm, printed Mar. 6, 2007 (2 pp.).

Vicente et al., "A Comparative Study of Vegetable Oils for Biodiesel Production in Spain," Energy & Fuels, 20:394-398, 2006 (published on Web Nov. 8, 2005) (5 pp.).

International Search Report and Written Opinion issued Sep. 14, 2010 for International Application No. PCT/US2010/043082.

(56) References Cited

OTHER PUBLICATIONS

International Search Report, PCT/US2010/62133, Aug. 30, 2011 (3 pp.).
Acetone MSDS, Sigma-Aldrich, Apr. 19, 2012 (8 pp.).
Benzene MSDS, Sigma-Aldrich, Apr. 27, 2012 (9 pp.).
Flores III, Heavy Oil Upgrading, Technology Today, Spring 2010 (6 pp.).
Toluene MSDS, Sigma-Aldrich, Apr. 24, 2012 (8 pp.).

* cited by examiner

METHODS FOR OBTAINING BITUMEN FROM BITUMINOUS MATERIALS

BACKGROUND

Bitumen is a heavy type of crude oil that is often found in naturally occurring geological materials such as tar sands, black shales, coal formations, and weathered hydrocarbon formations contained in sandstones and carbonates. Bitumen may be described as flammable brown or black mixtures or tar-like hydrocarbons derived naturally or by distillation from petroleum. Bitumen can be in the form of a viscous oil to a brittle solid, including asphalt, tars, and natural mineral waxes. Substances containing bitumen may be referred to as bituminous, e.g., bituminous coal, bituminous tar, or bituminous pitch. At room temperature, the flowability of bitumen is much like cold molasses. Bitumen may be processed to yield oil and other commercially useful products, primarily by cracking the bitumen into lighter hydrocarbon material.

As noted above, tar sands represent one of the well known sources of bitumen. Tar sands typically include bitumen, water, and mineral solids. The mineral solids can include coal and inorganic solids such as sand and clay. Tar sand deposits can be found in many parts of the world, including North America. One of the largest North American tar sands deposits is in the Athabasca region of Alberta, Canada. In the Athabasca region, the tar sands formation can be found at the surface, although it may be buried two thousand feet below the surface overburden or more.

Tar sands deposits can be measured in barrels equivalent of oil. It is estimated that the Athabasca tar sands deposit contains the equivalent of about 1.7 to 2.3 trillion barrels of oil. Global tar sands deposits have been estimated to contain up to 4 trillion barrels of oil. By way of comparison, the proven worldwide oil reserves are estimated to be about 1.3 trillion barrels.

The bitumen content of some tar sands may vary from approximately 3 wt % to 21 wt %, with a typical content of approximately 12 wt %. Accordingly, an initial step in deriving oil and other commercially useful products from bitumen may typically require extracting the bitumen content from the naturally occurring geological material. In the case of tar sands, this may include separating the bitumen from the mineral solids and other components of tar sands.

One conventional process for separating bitumen from mineral solids and other components of tar sands includes mixing the tar sands with hot water and, optionally, a process aid such as caustic soda (see, e.g., U.S. Pat. No. 1,791,797). Agitation of this mixture releases bitumen from the tar sands and allows air bubbles to carry released bitumen droplets to the top of the mixture where a bitumen froth is formed. The froth may include around 60% bitumen, 30% water, and 10% inorganic minerals. The bitumen-enriched froth is separated from the mixture, sometimes with the aid of a solvent, and further processed to isolate the bitumen product. For example, the froth may be treated with an aliphatic (pentane-type) or an aromatic (naphtha-type) solvent to produce a clean bitumen product that may serve as a refinery upgrader feed stock. The bulk of the mineral solids can also be removed to form a tailings stream. The tailings stream may also include water, solvent, precipitated asphaltenes (in the case where the asphaltene is not soluble in the solvent used to separate the bitumen-enriched froth from the mixture), and some residual bitumen.

One significant disadvantage of the hot water extraction process is the quality and composition of the tailings produced by such a method. The tailings may include precipitated asphaltenes and/or residual bitumen, which represent unrecovered hydrocarbon material, and consequently, diminished yield. Additionally, the tailings produced by hot water extraction methods may include solvents and other materials that pose environmental hazards when disposing of the tailings. Furthermore, tailings produced by hot water extraction methods may have a sludge-like consistency requiring disposition in costly and potentially environmentally hazardous tailings ponds or other mechanisms.

Co-pending and commonly owned prior art U.S. application Ser. No. 12/041,554 discloses a method that addresses many of the problems identified above with respect to hot water extraction methods. The method utilizes a series of carefully selected hydrocarbon solvents to extract bitumen from bituminous material while avoiding such issues as asphaltene precipitation and the creation of sludge-like tailings. In the method, a first hydrocarbon solvent capable of complete or near complete dissolution of bitumen is mixed with the material comprising bitumen to create a bitumen-enriched solvent phase within the mixture of material comprising bitumen and first hydrocarbon solvent. The bitumen-enriched solvent phase is then displaced out of the mixture by adding further first hydrocarbon solvent to the mixture. While this step removes most if not all of the bitumen-enriched solvent phase from the mixture, in some embodiments, some of the first hydrocarbon solvent added to the mixture may remain entrained in the first mixture. In order to remove the entrained first hydrocarbon solvent from the mixture, a second hydrocarbon solvent that has a lower viscosity and is more volatile than the first hydrocarbon solvent is added to the mixture to displace the first solvent out of the first mixture. Any second solvent remaining in the mixture may be removed by heating the mixture to a temperature above the boiling point temperature of the second solvent. Relatively minimal energy is required to carry out this heating step due to the high volatility of the second solvent and the relatively low heat capacity of the inorganic phase present in the first mixture. The result of this method is a high yield of extracted bitumen and a tailings phase that has relatively little or no solvent content and a desirable water content.

One possible shortcoming of the above described method is that in the process of removing the first solvent from the mixture through the addition of the second solvent, a portion of the first solvent may leave the mixture as a mixture of first solvent and second solvent. In order to recover and reuse the first and second solvents in the method and thereby make the method more efficient, an additional separation step is required to separate at least a portion of the first solvent from the second solvent. Often, the separation step requires a distillation tower that is capable of separating the first hydrocarbon solvent from the second hydrocarbon solvent. Such distillation towers can be expensive to construct, maintain, and operate, and add a degree of complexity to the overall method.

Additionally, the ability of the second solvents disclosed in U.S. application Ser. No. 12/041,554 to at least partially dissolve bitumen may result in the second solvents being less effective as materials for displacing first solvent from the mixture. The second solvents may act more like dissolution agents than displacement agents, resulting in less than complete removal of the first solvent from the mixture.

The second solvents disclosed in U.S. application Ser. No. 12/041,554 may also be environmentally unfavorable. For example, the use of aliphatic hydrocarbons may result in the undesirable generation of greenhouse gases. Additionally, the aliphatic hydrocarbons may be less biodegradable and more expensive than other solvents suitable for use in bitumen extraction.

Further disadvantages in the above-described method may arise when liquefied petroleum gasoline (LPG) is used as the second solvent. Applicants believe that the gas phase of the LPG typically requires high capital costs and complex configurations that would not be necessary when using a liquid solvent. For example, the use of LPG may necessitate a pressure vessel that is complicated and expensive to build and operate. Additionally, the conditions required to flash LPG from the tailings typically result in the freezing of the water content in the tar sands. The ice formed may then subsequently interfere with the separation of the LPG from the tailings.

SUMMARY

Disclosed are embodiments of a method for obtaining bitumen from bituminous materials and recovering the solvents used in the method. In some embodiments, the method may include a first solvent extraction performed on material comprising bitumen, a separation to separate a bitumen-enriched solvent phase and form first solvent-wet tailings, and a separation including the addition of a polar solvent to the first solvent-wet tailings to displace the first solvent as part of a polar solvent-first solvent mixture. In some embodiments, the polar solvent-first solvent mixture may phase separate into a polar solvent phase and a first solvent phase. In some embodiments, solvent-dry tailings are produced that may be disposed more easily and environmentally than tailings produced by other bitumen extraction methods.

In certain embodiments, the method may include mixing a material comprising bitumen with a first quantity of first solvent to form a first mixture. The first mixture may include a bitumen-enriched solvent phase. The method may also include separating bitumen-enriched solvent phase from the first mixture. Separation of bitumen-enriched solvent phase may result in the production of first solvent-wet tailings. The first solvent-wet tailings may include a first solvent component having minor amounts of bitumen dissolved therein. The method may further include adding polar solvent to the first solvent-wet tailings in order to separate a first solvent component. This separation may produce polar solvent-wet tailings. Furthermore, the first solvent may be separated from the first solvent-wet tailings as part of a polar solvent-first solvent mixture. In some embodiments, the polar solvent-first solvent mixture may phase separate into a polar solvent phase and a first solvent phase.

In some embodiments, a bitumen-enriched solvent phase may be separated from a mixture of material comprising bitumen and first solvent. Further, the method may include adding a polar solvent to the mixture having bitumen-enriched solvent phase separated therefrom. A polar solvent-first solvent mixture resulting from adding polar solvent to the mixture may phase separate into a polar solvent phase and a first solvent phase.

In some embodiments, a pressurized gas may be added over a mixture of first solvent and material comprising bitumen to separate a first quantity of bitumen-enriched solvent phase contained in the mixture. The method may also include adding a second quantity of first solvent to the first mixture to separate a second quantity of bitumen-enriched solvent phase from the first mixture and produce first solvent-wet tailings. The first solvent-wet tailings may include first solvent component. The method may also include adding a first quantity of polar solvent to the first solvent-wet tailings to separate a first quantity of first solvent component from the first solvent-wet tailings. The first quantity of first solvent component may be separated from the first solvent-wet tailings as part of a polar solvent-first solvent mixture. The method may also include adding a pressurized gas over the first solvent-wet tailings. The polar solvent-first solvent mixture may phase separate into a first solvent phase and a polar solvent phase.

It is to be understood that the foregoing is a brief summary of various aspects of some disclosed embodiments. The scope of the disclosure need not therefore include all such aspects or address or solve any or all issues noted in the background above. In addition, there are other aspects of the disclosed embodiments that will become apparent as the specification proceeds.

The foregoing and other features, utilities, and advantages of the subject matter described herein will be apparent from the following more particular description of certain embodiments as illustrated in the accompanying drawings. In this regard, it is to be understood that the scope of the invention is to be determined by the claims as issued and not by whether given subject includes any or all features or aspects noted in this Summary or addresses any issues noted in the Background.

BRIEF DESCRIPTION OF THE DRAWINGS

The preferred and other embodiments are disclosed in association with the accompanying drawings in which.

DETAILED DESCRIPTION

Before describing the details of the various embodiments herein, it should be appreciated that the terms "solvent," "a solvent" and "the solvent" may include one or more than one individual solvent compound unless expressly indicated otherwise. Mixing solvents that include more than one individual solvent compound with other materials can include mixing the individual solvent compounds simultaneously or serially unless indicated otherwise. It should also be appreciated that the term "tar sands" includes oil sands. The separations described herein can be partial, substantial or complete separations unless indicated otherwise. All percentages recited herein are volume percentages unless indicated otherwise.

Tar sands are used throughout this disclosure as a representative material comprising bitumen. However, the methods and systems disclosed herein are not limited to processing of tar sands. Any material comprising bitumen may be processed by the methods and systems disclosed herein.

Figure 1:
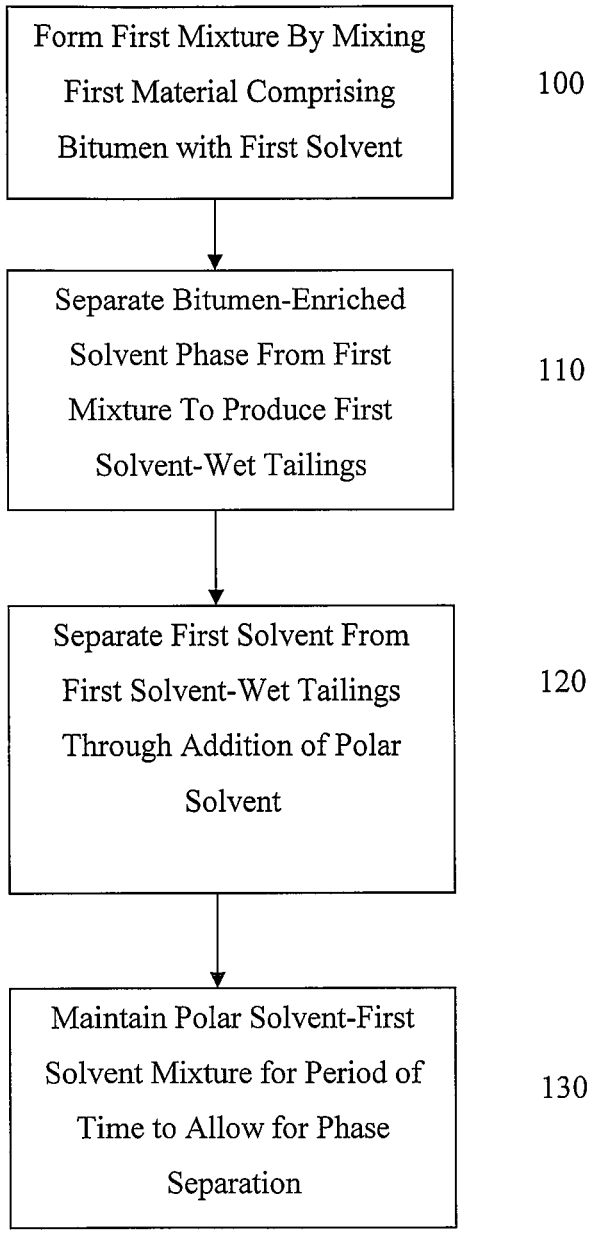
FIG. 1 is a flow chart detailing a method for obtaining bitumen from bituminous materials as disclosed herein.

With reference to FIG. 1, certain embodiments of a method for obtaining bitumen from material comprising bitumen include mixing a first quantity of material comprising bitumen with a first solvent 100 to form a first mixture, separating bitumen-enriched solvent phase from the first mixture 110 to produce first solvent-wet tailings, adding polar solvent to the first solvent-wet tailings 120 to produce polar solvent-wet tailings and a polar solvent-first solvent mixture, and maintaining the polar solvent-first solvent mixture for a period of time 130 to allow the polar solvent-first mixture to phase separate into a polar solvent phase and a first solvent phase.

Mixing a first quantity of material comprising bitumen with a first solvent 100 to form a first mixture represents a solvent extraction step (also sometimes referred to as dissolution, solvation, or leaching). Solvent extraction is a process of separating a substance from a material by selectively dissolving the substance of the material in a liquid. In this situation, the material comprising bitumen may be mixed with one or more solvents to dissolve bitumen in the solvent and thereby separate it from the other components of the material comprising bitumen (e.g., the mineral solids of tar sands).

The first solvent used when mixing 100 may include a hydrocarbon solvent. Any suitable hydrocarbon solvent or mixture of hydrocarbon solvents that is capable of dissolving bitumen may be used. In some embodiments, the hydrocarbon solvent is a hydrocarbon solvent that does not result in asphaltene precipitation. The hydrocarbon solvent or mixture of hydrocarbon solvents can be economical and relatively easy to handle and store. The hydrocarbon solvent or mixture of hydrocarbon solvents may also be generally compatible with refinery operations.

In certain embodiments, the first solvent may be a light aromatic solvent. The light aromatic solvent may be an aromatic compound having a boiling point temperature less than about 400° C. at atmospheric pressure. In some embodiments, the light aromatic solvent used in the first mixing step is an aromatic having a boiling point temperature in the range of from about 75° C. to about 350° C. at atmospheric pressure, and more specifically, in the range of from about 100° C. to about 250° C. at atmospheric pressure.

It should be appreciated that the light aromatic solvent need not be 100% aromatic compounds. Instead, the light aromatic solvent may include a mixture of aromatic and non-aromatic compounds. For example, the first solvent can include greater than zero to about 100 wt % aromatic compounds, such as approximately 10 wt % to 100 wt % aromatic compounds, or approximately 20 wt % to 100 wt % aromatic compounds.

Any of a number of suitable aromatic compounds may be used as the first solvent. Examples of aromatic compounds that can be used as the first solvent include benzene, toluene, xylene, aromatic alcohols and combinations and derivatives thereof. The first solvent can also include compositions, such as kerosene, diesel (including biodiesel), light gas oil, light distillate, commercial aromatic solvents such as Solvesso 100, Solvesso 150, and Solvesso 200 (also known in the U.S.A. as Aromatic 100, 150, and 200, including mainly $C_{10}$-$C_{11}$ aromatics, and produced by ExxonMobil), and/or naphtha. In some embodiments, the first solvent may have a boiling point temperature of approximately 75° C. to 375° C. Naphtha, for example, is particularly effective at dissolving bitumen and is generally compatible with refinery operations.

The material comprising bitumen used when mixing 100 may be any material that includes bitumen. In some embodiments, the material comprising bitumen includes any material including more than 3 wt % bitumen. Exemplary materials comprising bitumen include, but are not limited to, tar sands, black shales, coal formations, and hydrocarbon sources contained in sandstones and carbonates. The material comprising bitumen may be obtained by any known methods for obtaining material comprising bitumen, such as by surface mining, underground mining, or any in situ extraction methods, such as vapor extraction (Vapex) and steam assisted gravity drainage (SAGD) extraction. Any variations of these technologies may also be used.

Mixing a first quantity of material comprising bitumen and a first solvent 100 can be performed as a continuous, batch, or semi-batch process. Continuous processing is typically used in larger scale implementations. However, batch processing may result in more complete dissolution of bitumen than continuous processing.

The aim of mixing the first solvent and the material comprising bitumen at 100 may be to have the first solvent fully penetrate the material comprising bitumen so that the entire bitumen content of the material comprising bitumen may be dissolved by the first solvent. This includes ensuring that solvent diffuses through any outer partially dissolved bitumen layers to avoid the formation of tar balls. Accordingly, any mixing process or mixing device known to those of ordinary skill in the art that will allow for the first solvent to disperse throughout the bituminous material and solvate the bitumen content of the bituminous material may be used.

The amount of time during which the first solvent and material comprising bitumen are mixed may be one factor that affects how comprehensively the first solvent dissolves the bitumen content of the material comprising bitumen. Generally speaking, the material may be mixed for any period of time sufficient to dissolve the bitumen. In some embodiments, mixing may be carried out for from 5 seconds to 30 minutes. With tar sand clumps of 3 inches or less, the mixing time may be limited to less than 30 minutes in order to avoid emulsion formation or the break down of partially consolidated clay fragments as discussed in greater detail below.

The manner in which the first solvent and material comprising bitumen are mixed may be another factor that affects how comprehensively the first solvent dissolves the bitumen content of the material comprising bitumen. Generally speaking, any mixing method that blends the two materials together to ensure that the first solvent fully penetrates the material comprising bitumen to dissolve the bitumen may be used. In some embodiments, the mixing methods include the use of mixing devices, such as rotating blades or propellers. For example, the first solvent and the material comprising bitumen may be contained in a vessel having a mixing blade or propeller included therein. Engaging the mixing blade or propeller may mix the two materials together and help ensure that the first solvent fully penetrates the material comprising bitumen to dissolve the bitumen. In some embodiments, mixing may also be accomplished through the use of a rotating vessel in which the first solvent and material comprising bitumen may be contained. For example, the material comprising bitumen and the first solvent may be mixed by using a rotary drum plus trommel screen. The material comprising bitumen and first solvent may be added to the rotary drum at the same time to thereby produce a first mixture with barren over size material removed from the first mixture. In some embodiments, the mixing function can be combined with a transport function. In other words, mixing may be accomplished as material comprising bitumen is being transported into a separation unit. For example, solvent can be added to a screw or conventional conveyor used to convey material comprising bitumen into a separation unit in such a way that the conveyor becomes the mixing/dissolution device as well as the transportation device.

The energy used to mix the first solvent and the material comprising bitumen may also be controlled to ensure adequate bitumen dissolution while avoiding certain undesirable side effects. In some embodiments, the energy used when mixing 100 may be controlled in order to avoid the break down of partially consolidated clay fragments that may be present in the first mixture. These clay fragments may be present in the first mixture if the original material comprising bitumen includes clay, such as may be the case in tar sands. If excessive energy is used to perform the mixing, the clay fragments may break down into finely suspended particles that can subsequently cause problems during separation steps, such as pressure filtration. However, by controlling the amount of energy used when mixing, the breakdown of the claim fragments may be avoided while still ensuring sufficient dissolution of bitumen. If excessive energy is used, water that is originally present in the ore or that is added to the ore may combine with first solvent to form water-oil emulsions. These emulsions can further be stabilized by clay particles that are also produced during the mixing process when using excessive energy. Such emulsions could limit the flow of solvent or ultimately clog the filters that are used to separate the solvents from the inorganic component of the oil sand.

In some embodiments, adequate mixing to ensure bitumen dissolution but avoid clay fragment break down may be achieved by utilizing low intensity blending apparatus. Exemplary apparatus may include a suitable batch or continuous mixer of the type used in cement mixing, including industrial or free standing cement mixers or mobile truck mounted cement mixers that permit mixing while transporting material comprising bitumen and solvent. The relatively slow rotation of the trommel may provide the suitable amount of mixing for dissolution without resulting in clay fragment disaggregation or disintegration.

The first solvent added to the material comprising bitumen may be either fresh first solvent or first solvent that has already been mixed with and separated from the material comprising bitumen as discussed in greater detail below. First solvent that has already been mixed with and separated from material comprising bitumen may be considered wash solvent. The wash solvent may have a bitumen content. In some embodiments, the wash solvent may include from about 5 wt % to about 70 wt % bitumen and from about 30 wt % to about 95 wt % first solvent.

The amount of the first solvent added to the material comprising bitumen may be a sufficient amount to effectively dissolve at least a portion, or desirably all, of the bitumen in the material comprising bitumen. Different amounts of first solvent may be used depending on whether the first solvent is fresh first solvent or wash solvent. In certain embodiments, the amount of the fresh first solvent mixed with the material comprising bitumen may be approximately 0.5 to 3.0 times the amount of bitumen by volume contained in the material comprising bitumen, approximately 0.6 to 2.0 times the amount of the bitumen by volume contained in the material comprising bitumen, or approximately 0.75 to 1.5 times the amount of bitumen by volume contained in the material comprising bitumen. In certain embodiments, the amount of the wash solvent mixed with the material comprising bitumen may be approximately 0.6 to 5.0 times the amount of bitumen by volume contained in the material comprising bitumen, approximately 0.7 to 3.5 times the amount of the bitumen by volume contained in the material comprising bitumen, or approximately 0.75 to 2.0 times the amount of bitumen by volume contained in the material comprising bitumen.

The temperature of the first solvent mixed with the material comprising bitumen is not limited but may be adjusted to improve the overall method. In some embodiments, the first solvent may be mixed with the material comprising bitumen at an elevated temperature in order to adjust the viscosity of the first mixture and consequently effect the rate at which bitumen-enriched solvent phase can be filtered from the mixture of first solvent and material comprising bitumen (as discussed in greater detail below). The heat capacity of the non-bituminous components of the material comprising bitumen (e.g., sand particles) is relatively low as compared to the heat capacity of first solvents. Thus, if a first solvent at a temperature of, for example, 100° C. is mixed with material comprising bitumen at a temperature of, for example, 20° C., the first mixture may have a temperature in the range of about 40-50° C. In some embodiments, a first solvent with an elevated temperature may be acquired by utilizing recycled first solvent. For example, first solvent that has been recovered through evaporation or distillation and then condensed will be at a relatively high temperature (i.e., close to the solvent boiling point temperature). Accordingly, this first solvent with elevated temperature may be used in the mixing at 100 to obtain a first mixture with a viscosity for improved filtration.

It should be noted that the ratio of the first solvent to bitumen may be affected by the amount of bitumen in the material comprising bitumen. For example, when the material comprising bitumen is a high grade tar sands ore (e.g., greater than 12 wt % bitumen), the high grade tar sands ore can be processed with a solvent to bitumen ratio as low as 2:1. However lower grade tar sands ore (e.g., 6 wt % bitumen) may be processed with a solvent to bitumen ratio greater than 3:1 to provide sufficient liquid to fill up the open space between the particles.

The first mixture of the first solvent and the material comprising bitumen may generally result in the formation of a bitumen-enriched solvent phase within the first mixture, with the majority of the bitumen from the material comprising bitumen dissolved in the bitumen-enriched solvent phase. In some embodiments, 90%, preferably 95%, and most preferably 99% or more of the bitumen in the material comprising bitumen can be dissolved in the first solvent and becomes part of the bitumen-enriched solvent phase.

The bitumen-enriched solvent phase may then be separated from the first mixture at 110. Any suitable method for separating bitumen-enriched solvent phase from the first mixture may be used, including the use of multiple separation methods in parallel or in series. Exemplary separation methods include, but are not limited to, filtering, settling, and displacing.

Filtering of the first mixture may generally include any process wherein a filter medium is used to maintain the non-bitumen components of the material comprising bitumen on one side of the filter medium while allowing the bitumen-enriched solvent phase to collect on the opposite side of the filter medium by passing through the filter medium. Any type of filter medium may be used provided the filter medium is capable of preventing the flow of at least a portion of the non-bitumen components through the filter medium while allowing bitumen-enriched solvent phase to flow through the filter medium.

In some embodiments, the filtering process may involve the use any suitable type of filter press. Exemplary filter presses include, but are not limited to, vertical plate and frame-type filter presses, horizontal plate and frame-type filter presses, and pressure filters (including automatic pressure filters). Other suitable types of filters are discussed in Chapter 18 of Perry's Chemical Engineers' Handbook (2007). In the case of a plate and frame-type filter press, the first mixture may be loaded in a frame chamber lined on either side with filter clothes. As the first mixture fills the frame chamber, the bitumen-enriched solvent phase may pass through the filter clothes and out of the frame chamber, leaving the non-bitumen components of the material comprising bitumen behind. Any plate and frame-type filter press known to those of ordinary skill in the art may be used. An exemplary vertical plate and frame-type filter press suitable for use in this method is described in U.S. Pat. No. 4,222,873. An exemplary horizontal plate and frame-type filter press suitable for use in this method is described in U.S. Pub. Pat. App. No. 2006/0283785.

Any of the pressure filtration methods suitable for use in separating bitumen-enriched solvent phase from the first mixture may include the introduction of pressurized gas over the first mixture to further promote separation of bitumen-enriched solvent phase from the first mixture. For example, in the case of filtering the first mixture via a plate and frame-type filter press, pressurized gas may be introduced into the frame chamber after the frame chamber has been filled with the first mixture to further promote the separation of the bitumen-enriched solvent phase from non-bitumen components in the first mixture. Bitumen-enriched solvent phase liberated from the non-bituminous component by the introduction of pressurized gas may then pass out of the filter chamber. Alternatively, the liberated bitumen-enriched solvent phase may remain in the first mixture, but may be repositioned so as to increase the likelihood that the liberated bitumen-enriched solvent phase may be displaced from the first mixture by the further addition of first solvent to the first mixture.

Any suitable gas may be used for promoting separation. In some embodiments, the gas may be any inert gas. In certain embodiments, the gas may be nitrogen, carbon dioxide or steam. The amount of gas used is not limited. In the case of a plate and frame-type filter press, 1.8 $m^3$ to 10.6 $m^3$ of pressurized gas per ton of material comprising bitumen may be introduced into the frame chamber. This is equivalent to a range of about 4.5 liters to 27 liters of pressurized gas per liter of material comprising bitumen. In some embodiments, 3.5 $m^3$ of pressurized gas per ton of material comprising bitumen may be used.

Settling of the first mixture may generally include any process wherein the heavier components of the first mixture are allowed to settle to the bottom of the first mixture under the influence of gravity or externally applied forces or a combination thereof, while the lighter components of the first mixture reside at the top of the first mixture and above the heavier components of the mixture. Settling may also result in the formation of a layer of porous material that acts as a filter aid through which the lighter material and wash substance can readily pass.

In some embodiments, settling of the first mixture may result in the non-bituminous components of the material comprising bitumen (e.g., mineral solids of tar sands) settling to the bottom of the first mixture while the bitumen-enriched solvent phase will remain at the top of the first mixture and above the non-bituminous components of the material comprising bitumen. Bitumen-enriched solvent phase may then be separated from the first mixture by collecting the bitumen-enriched solvent phase from the top of the settled first mixture. In some embodiments, less than 100% of the bitumen-enriched solvent phase present in the first mixture may be separated from the settled first mixture. Any remaining bitumen-enriched solvent phase may be removed from the settled first mixture via a second separation process.

Settling may be carried out according to any known settling technique suitable for use with mixtures of solvents and materials comprising bitumen. In some embodiments, the settling technique may include storing the first mixture in a vessel for a period of time, during which gravity acts on the first mixture to cause the heavier inorganic components of the first mixture to settle to the bottom of the vessel. Any suitable period of time may be used to allow for settling. Generally speaking, settling carried out for longer periods of time will result in greater separation between the non-bituminous components of the material comprising bitumen and the bitumen-enriched solvent phase. Mechanical (e.g., vibration, ultrasound) and chemical (e.g., surfactants) settling techniques may also be used Any method of separating bitumen-enriched solvent phase from the settled first mixture may be used. In some embodiments, the bitumen-enriched solvent phase may be decanted from the top of the settled first mixture. Decanting generally includes pouring the top portion of the settled first mixture (i.e., bitumen-enriched solvent phase) out of a vessel in which the first mixture was settled while retaining the bottom portion of the settled mixture (i.e., the non-bituminous components of the material comprising bitumen) in the settling vessel. Separation of bitumen-enriched solvent phase from a settled first mixture may also include skimming bitumen-enriched solvent phase from the top of the settled first mixture.

As with the filtering described above, any suitable settling technique may include the introduction of pressurized gas over the first mixture to further promote separation of bitumen-enriched solvent phase from the non-bituminous components of the first mixture. Any suitable gas may be used for promoting separation. In some embodiments, the gas may be an inert gas. In certain embodiments, the gas may be nitrogen, carbon dioxide or steam. The amount of pressurized gas used is not limited and may be similar or identical to the quantities described above with respect to the use of pressurized gas with filtering.

Displacing bitumen-enriched solvent phase from the first mixture in order to separate the bitumen-enriched solvent phase from the first mixture may generally include the addition of a substance to the first mixture that forces bitumen-enriched solvent phase out of the first mixture. Substance added to the first mixture may replace bitumen-enriched solvent phase in the interstitial spaces between non-bituminous components in the first mixture and thereby force bitumen-enriched solvent phase out of the first mixture. In this manner, the first mixture becomes "wet" with the substance added to the first mixture.

Any substance that will displace bitumen-enriched solvent from the first mixture may be used. In some embodiments, the substance added to the first mixture is a first solvent as described in greater detail above (i.e., a light hydrocarbon solvent). The substance added may be the same type of first solvent as mixed with the material comprising bitumen at 100, or may be a different type of first solvent.

Any suitable amount of first solvent may be added to the first mixture in order to displace bitumen-enriched solvent phase from the first mixture. In some embodiments, the first solvent is added to the first mixture in an amount of from about 10% to about 400% of the amount of first solvent mixed with the material comprising bitumen at 100. The first solvent used in displacement separation may also be added to the first mixture in any suitable fashion.

In some embodiments, the separation of bitumen-enriched solvent phase from the first mixture via a displacement process may be carried out by loading the first mixture in a vertical column, followed by adding first solvent into the top end of the vertical column. The first solvent may then flow downwardly through the first mixture while displacing bitumen-enriched solvent phase from the first mixture. The displaced bitumen-enriched solvent phase may then exit the vertical column at the bottom end of the vertical column.

Any method of loading the first mixture in the vertical column may be used. The first mixture may be poured into the vertical column or, when the liquid phase of the first mixture has an appropriate first viscosity (e.g., 2 to 50 cP), the first mixture may be pumped into the vertical column. In certain embodiments, the first mixture may be loaded into the vertical column by introducing the first mixture into the column at the top end of the vertical column. The bottom end of the vertical column may be blocked, such as by a metal filter screen, a layer of sand with a controlled permeability, or by virtue of the bottom end of the vertical column resting against a fixed object. Accordingly, introducing first mixture at the top end of the vertical column fills the vertical column with first mixture.

The amount of first mixture loaded in the vertical column may be such that the first mixture substantially fills the vertical column with first mixture. In some embodiments, first mixture may be added to the vertical column to occupy 90% or more of the volume of the vertical column. In some embodiments, the first mixture is not filled to the top of the vertical column so that room is provided to inject first solvent or other materials into the vertical column.

The column may have a generally vertical orientation. The vertical orientation includes aligning the column substantially perpendicular to the ground, but also includes orientations where the column forms angles less than 90° with the ground. The column may generally be oriented at any angle that results in gravity aiding the flow of the first solvent or other injected materials from the top end of the column to the bottom end. In some embodiments, the column may be oriented at an angle anywhere within the range of from about 1° to 90° with the ground. In preferred embodiments, the column may be oriented at an angle anywhere within the range of from about 15° to 90° with the ground.

The material of the vertical column is also not limited. Any material that will hold the first mixture within the vertical column may be used. The material is also preferably a non-porous material such that various liquids injected into the vertical column may only exit the column from one of the ends of the vertical column. The material may be a corrosive resistant material so as to withstand the potentially corrosive components of the first mixture loaded in the column as well as any potentially corrosive materials injected into the vertical column.

The shape of the vertical column is not limited to a specific configuration. Generally speaking, the vertical column has two ends opposite one another, designated a top end and a bottom end. The cross-section of the vertical column may be any shape, such as a circle, oval, square or the like. The cross-section of the vertical column may change along the height of the column, including both the shape and size of the vertical column cross-section. The vertical column may be a straight line vertical column having no bends or curves along the height of the vertical column. Alternatively, the vertical column may include one or more bends or curves.

Any dimensions may be used for the vertical column, including the height, inner cross sectional diameter and outer cross sectional diameter of the vertical column. In some embodiments, the ratio of height to inner cross sectional diameter (i.e., aspect ratio) may range from 0.5:1 to 15:1.

Upon loading the first mixture into the vertical column, a portion of the bitumen-enriched solvent phase may be removed from the first mixture by applying a gas overpressure to the first mixture loaded in the vertical column. The overpressure may separate free bitumen-enriched solvent phase entrained in the first mixture and remove the bitumen-enriched solvent phase from the vertical column. Any bitumen-enriched solvent phase removed from the vertical column through the application of overpressure may be collected as it leaves the vertical column so that it may undergo further processing. Any suitable gas may be used for the application of overpressure to the vertical column. In some embodiments, the gas is an inert gas, such as nitrogen.

After application of overpressure to the first mixture loaded in the vertical column, virgin first solvent may be added into the vertical column. The virgin first solvent may be added into the top end of the column such that the virgin first solvent flows down and through the first mixture loaded in the vertical column. The virgin first solvent may be added into the vertical column by any suitable method. In some embodiments, the virgin first solvent is poured into the vertical column at the top end and allowed to flow down through the first mixture loaded therein under the influence of gravity.

The amount of virgin first solvent added to the first mixture is not limited. In some embodiments, the amount is preferably enough virgin first solvent to displace most or all of the dissolved bitumen content of the first mixture. In some embodiments, the amount of virgin first solvent added is from about 0.5 to 5.0 times the amount of bitumen by volume in the original material comprising bitumen.

In some embodiments, the addition of the virgin first solvent is carried out under flooded conditions. In other words, more virgin first solvent is added to the top of the vertical column than what flows down through the first mixture, thereby creating a head of solvent at the top of the vertical column.

Upon addition into the vertical column, the virgin first solvent may flow downwardly through the height of the column via void spaces in the first mixture. The virgin first solvent may flow downwardly through the force of gravity or by an external force applied to the vertical column. Examples of external forces applied include the application of pressure at the top of the vertical column or the application of suction at the bottom of the vertical column. The virgin first solvent will typically travel the flow of least resistance through the first mixture. As the virgin first solvent flows downwardly through the first mixture, the virgin first solvent displaces bitumen-enriched solvent phase from the first mixture. When a column having a low aspect ratio is used, an appropriate first solvent flow distribution system may be installed to provide good washing efficiencies even with the relatively short column height. An example of a first solvent flow distribution system suitable for use in the column is described in U.S. Pat. No. 4,537,217, U.S. Pat. No. 7,001,521, and U.S. Pub. App. No. 2005/0000879.

The bitumen-enriched solvent phase being displaced by the addition of the virgin first solvent may eventually exit the bottom end of the vertical column. Some of the first solvent added to the first mixture loaded in the vertical column may remain in the vertical column as part of the first mixture. In this manner, the addition of first solvent to the first mixture loaded in the vertical column combined with the extraction of the bitumen from the first mixture loaded in the vertical column may result in the first mixture becoming first solvent-wet tailings.

The bitumen-enriched solvent phase exiting the bottom end of the vertical column may be collected for further use and processing. Any method of collecting the bitumen-enriched solvent may be used, such as by providing a collection vessel at the bottom end of the vertical column. The bottom end of the vertical column may include a metal filter screen having a mesh size that does not permit first mixture to pass through but which does allow for bitumen-enriched solvent to pass through and collect in a collection vessel located under the screen. Collection of bitumen-enriched solvent may be carried out for any suitable period of time. In some embodiments, collection is carried out for 2 to 30 minutes.

The addition of first solvent and the subsequent collection of bitumen-enriched solvent phase may be repeated several times. In other words, after adding first solvent and collecting the bitumen-enriched solvent at the bottom of the vertical column, additional first solvent may be added to the vertical column to displace additional bitumen-enriched solvent phase still contained in the first mixture. Repeating the addition of first solvent may increase the overall extraction rate of bitumen from the first mixture. In some embodiments, multiple additions of first solvent may result in removing 99% or more of the bitumen contained in the first mixture.

In certain embodiments, displacement of bitumen-enriched solvent phase from the first mixture may be accomplished via a countercurrent washing process. The countercurrent washing process generally includes moving the first mixture in one direction while passing first solvent through the first mixture in an opposite direction. For example, the first mixture may be loaded at the bottom of a screw classifier conveyor positioned at an incline, while first solvent may be introduced at the top of the screw classifier conveyor. An exemplary screw classifier conveyor suitable for use in this method is described in U.S. Pat. No. 2,666,242. As the screw classifier conveyor moves the first mixture upwardly, the first solvent flows down the inclined screw classifier conveyor and passes through the first mixture. The first solvent displaces bitumen-enriched solvent phase contained in the first mixture, thereby "washing" bitumen from the first mixture.

Separation of bitumen-enriched solvent phase and the first mixture naturally occurs based on the configuration of the screw classifier conveyor, with the predominantly liquid bitumen-enriched solvent phase collecting at one end of the washing unit and the predominantly solid first mixture collecting at the opposite end of the washing unit. For example, when an inclined screw classifier conveyor is used, bitumen-enriched solvent phase may collect at the bottom of the screw classifier conveyor, while the first mixture may collect at the top of the screw classifier conveyor.

As described above, some of the first solvent used in the displacement separation process will remain in the first mixture rather than pass all the way through the first mixture. In the countercurrent washing process, some of the first solvent moving through the first mixture in a direction opposite to the direction the first mixture is traveling in may be retained in the first mixture. The removal of bitumen together with the retained first solvent may result in the formation of first solvent-wet tailings.

The countercurrent process may include multiple stages. For example, after a first pass of first solvent through the first mixture, the resulting bitumen-enriched solvent phase may be passed through the first solvent-wet tailings several more times. Alternatively, additional quantities of fresh first solvent may be passed through the first solvent-wet tailings one or more times. In this manner, the bitumen-enriched solvent phase or fresh quantities of first solvent become progressively more enriched with bitumen after each stage and the first solvent-wet tailings lose progressively more bitumen after each stage. In some embodiments, multiple countercurrent washing stages may result in removing 99% or more of the bitumen contained in the first mixture.

In another displacement method, virgin first solvent may be added to first mixture loaded in a frame chamber of a plate and frame-type filter press. The frame chamber has a limited volume that may be mostly occupied by first mixture. The addition of virgin first solvent into the first mixture loaded in the frame chamber may therefore force the bitumen-enriched solvent phase out of the frame chamber through the filter clothes lining either side of the frame chamber. Some of the virgin first solvent may be retained in the first mixture loaded in the frame chamber. Therefore, one result of adding virgin first solvent to the first mixture loaded in the frame chamber may be the transformation of the first mixture into first solvent-wet tailings.

Any of the displacement methods may also utilize pressurized gas as part of the separation process. Applying a pressurized gas over the first mixture prior to or after the addition of virgin first solvent may facilitate the separation of bitumen-enriched solvent phase from the non-bitumen components of the first solvent-wet tailings. Liberated bitumen-enriched solvent phase may either separate from the first mixture as a result of the overpressure, or may be repositioned within the first mixture so that it may then be removed when adding virgin first solvent to the first mixture. Any amount of pressurized gas may be introduced over the first mixture to help remove dissolved bitumen. In some embodiments, between 1.5 and 5.7 $m^3$ of gas per ton of material comprising bitumen feed is used.

In the case of first mixture loaded in a vertical column, the pressurized gas may be added into the vertical column in any suitable manner. In some embodiments, the gas is added to a freeboard on top of the first mixture loaded in the vertical column. In some embodiments, one or more gas injection lines run down through the first mixture loaded in the vertical column. These lines may be placed down the center of the vertical column, along the sides of the vertical column, or a combination of both. In some embodiments, a double walled vertical column is provided, with the internal wall being porous. Gas may be pumped into the space between the two walls. The gas will then travel into the first mixture loaded in the inner most cylinder of the vertical column by traveling through the porous inner wall.

The bitumen-enriched solvent phase separated from the first mixture according to any of the above described separation methods may generally include from about 25 wt % to about 75 wt % of bitumen and from about 25 wt % to about 75 wt % of first solvent. In some embodiments, the bitumen-enriched solvent phase includes little or no non-bitumen components of the material comprising bitumen (e.g., mineral solids).

The first solvent-wet tailings that may be produced by the above-described separation methods may generally include from about 75 wt % to about 95 wt % non-bitumen components of the material comprising bitumen and from about 5 wt % to about 25 wt % first solvent. The first solvent component of the first solvent-wet tailings may have bitumen dissolved therein. Accordingly, in some embodiments, the first solvent-wet tailings may include a minor amount of bitumen.

The separation of the bitumen-enriched solvent phase from the first mixture according to any of the above-described separation procedures can be performed as a continuous, batch, or semi-batch process. Continuous processing is typically used in larger scale implementations. However, batch processing may result in more complete separations than continuous processing.

In some embodiments, separation of bitumen-enriched solvent phase may utilize two or more of the above-described separation methods. In certain embodiments, a first quantity of bitumen-enriched solvent phase is separated from the first mixture via either settling or filtration, and a second quantity of bitumen-enriched solvent phase is separated from the first mixture via displacement. Separating of bitumen-enriched solvent phase from the first mixture in this manner may increase the amount of bitumen separated from the first mixture as compared to when only a single separation method is used. In some embodiments, utilizing two or more separation methods may result in removal of more than 95% of the bitumen contained in the first mixture.

In one example, a first filtration separation is carried out to remove a first quantity of bitumen-enriched solvent from the first mixture. The first filtration may include filtering the first mixture in a plate and frame-type filter press. As described above, the first mixture may be loaded in a frame chamber and pressure may be exerted on the first mixture to force the bitumen-enriched solvent phase out of the frame chamber through the filter clothes on either side of the frame chamber. Over 99% of the non-bituminous components of the first mixture may remain in the frame chamber. Once the first quantity of bitumen-enriched solvent phase is collected, a displacement separation may occur by injecting a second quantity of first solvent into the first mixture loaded in the frame chamber. The first solvent displaces bitumen-enriched solvent phase still contained in the first mixture and forces it out of the frame chamber through the filter clothes. In this manner, a second quantity of bitumen-enriched solvent phase may be collected. The second quantity of bitumen-enriched solvent phase may have a higher solvent to bitumen ratio than the first quantity of bitumen-enriched solvent phase.

In another example, the first separation process includes filtering the first mixture in a filter press as described above. After filtration, the first mixture may be removed from the frame chamber in order to undergo displacement separation by washing the first mixture in a countercurrent process. The first mixture may be loaded at the bottom of an inclined screw classifier conveyor and a second quantity of first solvent may be introduced at the top of the inclined screw classifier conveyor. As the first mixture moves up the conveyor, the second quantity of first solvent flows down the conveyor and through the first mixture, displacing a second quantity of bitumen-enriched solvent phase. The second quantity of bitumen-enriched solvent phase displaced from the first mixture may collect at the bottom end of the screw classifier conveyor.

In another example, the first separation process includes filtering the first mixture in a filter press as described above. After filtration, the first mixture may be removed from the frame chamber in order to undergo displacement separation by loading the first mixture in a vertical column, followed by injecting a second quantity of first solvent into the first mixture loaded in the vertical column. The second quantity of first solvent may be injected into the first mixture at the top of the vertical column such that the second quantity of first solvent flows downwardly through the first mixture and displaces bitumen enriched solvent phase still contained in the first mixture. The displaced bitumen-enriched solvent phase, along with a portion of the second quantity of first solvent, may exit the vertical column at the bottom end of the vertical column, where it is collected for further processing of the bitumen-enriched solvent phase.

The second quantity of bitumen-enriched solvent phase collected from the second separation process may be combined with the bitumen-enriched solvent phase collected from the first separation process prior to any further processing conducted on the bitumen-enriched solvent phase.

As noted above, first solvent-wet tailings may include from about 5 wt % to about 25 wt % of the first solvent, and it is desirable to remove this first solvent from the tailings to make the tailings more environmentally friendly. A polar solvent may be added 120 to the first solvent-wet tailings in order to accomplish this separation of first solvent from the first solvent-wet tailings. More specifically, the addition of polar solvent to the first solvent-wet tailings may displace the first solvent and force the first solvent out of the first solvent-wet tailings as part of a mixture of first solvent and polar solvent. In some embodiments, this mixture of first solvent and polar solvent may already be phase disengaged into a first solvent phase and a polar solvent phase when it leaves the first solvent-wet tailings.

The removal of first solvent as part of a mixture of polar solvent and first solvent leaving the tailings may provide an advantage over previously known bitumen extraction methods with respect to the cost and complexity associated with separation and recovery of the various solvents used in bitumen extraction methods. In conventional bitumen extraction methods, the solvent mixtures produced typically require processing equipment such as distillation towers in order to separate and recover any of the solvents. However, the polar solvent and first solvent used in the extraction method discussed herein may phase separate by, for example, merely maintaining the mixture for a period of time. Such separation can be manipulated to occur or occur naturally due to the solubility phase boundary between the water, first solvent, and polar solvent relative ratios. In some embodiments, part or all of the water content of the mixture of polar solvent and first solvent originates from the water present in the original material comprising bitumen. In other embodiments, water can be added to the mixture to create phase separation. Upon phase separation of the previously homogenous mixture of polar solvent and first solvent, separation of the first solvent and polar solvent may be accomplished through the use of relatively simple procedures and equipment, such as decantation.

Some polar solvents may also provide an advantage over previously disclosed bitumen extraction methods in that selected polar solvents are more biodegradable than other solvents (e.g., alkane-type solvents). Accordingly, a bitumen extraction method utilizing polar solvents may be more environmentally friendly than previously known bitumen extraction methods.

The polar solvent added 120 to the first solvent-wet tailings can be any suitable polar solvent that is capable of displacing the first solvent. In some embodiments, the polar solvent may be an oxygenated hydrocarbon. Oxygenated hydrocarbons may include any hydrocarbons having an oxygenated functional group. Oxygenated hydrocarbons may include alcohols, ketones and ethers. Oxygenated hydrocarbons as used in the present application do not include alcohol ethers or glycol ethers.

Suitable alcohols for use as the polar solvent may include methanol, ethanol, propanol, and butanol. The alcohol may be a primary (e.g., ethanol), secondary (e.g., isopropyl alcohol) or tertiary alcohol (e.g., tert-butyl alcohol).

As noted above, the polar solvent may also be a ketone. Generally, ketones are a type of compound that contains a carbonyl group (C═O) bonded to two other carbon atoms in the form: R1(CO)R2. Neither of the substituents R1 and R2 may be equal to hydrogen (H) (which would make the compound an aldehyde). A carbonyl carbon bonded to two carbon atoms distinguishes ketones from carboxylic acids, aldehydes, esters, amides, and other oxygen-containing compounds. The double-bond of the carbonyl group distinguishes ketones from alcohols and ethers. The simplest ketone is acetone, CH3-CO—CH3 (systematically named propanone).

In some embodiments, the polar solvent is a polar solvent that is miscible with the first solvent. By selecting a polar solvent that is soluble in the first solvent (or in which the first solvent is soluble), the polar solvent may form a homogenous mixture with the first solvent contained in the first solvent-wet tailings as the polar solvent passes through the first solvent-wet tailings. As some bitumen may be present in the first solvent, the homogenous mixture may also include a bitumen content. This homogenous mixture of polar solvent and first solvent (and possibly bitumen) may then pass out of the tailings to thereby accomplish the removal the first solvent content from the tailings. In some embodiments, the homogenous mixture of polar solvent and first solvent may begin to phase separate while still in the tailings and thus may leave the tailings in a phase disengaged state.

The polar solvent or mixture of polar solvents can be economical and relatively easy to handle and store. The polar solvent or mixture of polar solvents may also be generally compatible with refinery operations.

The polar solvent added to the first solvent-wet tailings need not be 100% polar solvent, although in some embodiments, the polar solvent added to the first solvent-wet tailings is made up entirely of polar solvent. The polar solvent may include a mixture of polar compounds and non-polar compounds. However, in some embodiments, the mixture added to the first solvent-wet tailings includes more than about 50 wt % polar solvent, and preferably more than about 70 wt % polar solvent.

Adding polar solvent to the first solvent-wet tailings may be carried out in any suitable manner that results in first solvent displacement from the first solvent-wet tailings. In some embodiments, polar solvent may be added to the first solvent-wet tailings in a similar or identical manner to the addition of first solvent to the first mixture described in greater detail above.

The amount of the polar solvent added to the first solvent-wet tailings is sufficient to effectively displace at least a portion, or desirably all, of the first solvent in the first solvent-wet tailings. The amount of polar solvent added to the first solvent-wet tailings is approximately 0.5 to 4.0 times the amount of bitumen by volume originally contained in the material comprising bitumen.

As described in greater detail above, the polar solvent may be added to first solvent-wet tailings that contain only a minor bitumen content. In some embodiments, the relatively minor amount of bitumen present in the first solvent-wet tailings may aid in the efficient displacement of first solvent from the first solvent-wet tailings through the addition of polar solvent. This may be due to the ability of the polar solvent to serve primarily as a displacement agent for removing the first solvent from the first solvent-wet tailings, rather than also having to serve as a dissolution and/or displacement agent for the bitumen content of the first solvent-wet tailings.

Additionally, the near absence of bitumen in the first solvent-wet tailings may help to minimize the complexity and cost of operating and maintaining the various embodiments of the methods described herein. As discussed in greater detail above, the method may include the production and isolation of bitumen-enriched first solvent phase. Consequently, the method may also require specific processing equipment for separating the bitumen-enriched first solvent phase into first solvent and bitumen. If the method were to also produce bitumen-enriched polar solvent phase, additional processing equipment for separating the bitumen-enriched polar solvent phase into polar solvent and bitumen may be required. Thus, by only adding polar solvent to first solvent-wet tailings that are essentially bitumen-free and thereby avoiding the production of bitumen-enriched polar solvent phase, the complexity of the method may be minimized through a reduction in the amount of processing equipment needed for separating bitumen from solvents used in the method.

In some embodiments, the addition of polar solvent to the first solvent-wet tailings results in the removal of 95% or more of the first solvent in the first solvent-wet tailings. As alluded to above, some of the polar solvent may exit the first solvent-wet tailings with the first solvent, thereby resulting in the first solvent leaving the first solvent-wet tailings as a polar solvent-first solvent mixture. The polar solvent-first solvent mixture may include from about 5 wt % to about 60 wt % first solvent and from about 40 wt % to about 95 wt % polar solvent.

Some of the polar solvent may also remain in the first-solvent wet tailings. Combined with the removal of the first solvent, this may result in the first solvent-wet tailings becoming polar solvent-wet tailings upon the addition of polar solvent to the first solvent-wet tailings. In some embodiments, the polar solvent-wet tailings include from about 80 wt % to about 95 wt % non-bitumen components and from about 5 wt % to about 20 wt % polar solvent.

In some embodiments, adding polar solvent to the first solvent-wet tailings 120 utilizes a plate and frame-type filter press to separate the first solvent from the first solvent-wet tailings. The plate and frame-type filter press may be a separate plate and frame-type filter press from the plate and frame-type filter press that may be used to separate the bitumen-enriched solvent phase from the first mixture, or the same plate and frame-type filter press may be used to separate the bitumen-enriched solvent phase from the first mixture and to separate the first solvent from the first solvent-wet tailings. When the same plate and frame-type filter press is used, the method may include adding polar solvent to the first solvent-wet tailings still contained in the frame chamber. In other words, the method need not include a step of removing the first solvent-wet tailings (containing mostly solid phases) from the plate and frame-type filter press before mixing with polar solvent. The polar solvent may be pumped into the plate and frame-type filter press where it displaces the first solvent component of the first solvent-wet tailings located in the frame chambers as it either filters down from the top to the bottom or is pumped upwards from the bottom to the top.

The separation of first solvent from the first solvent-wet tailings through the addition of polar solvent may also be carried out as a countercurrent washing process. The countercurrent process generally includes moving the first solvent-wet tailings in one direction while passing the polar solvent through the first solvent-wet tailings in an opposite direction. For example, the first solvent-wet tailings may be loaded at the bottom of a screw classifier conveyor positioned at an incline, while polar solvent is introduced at the top of the inclined screw classifier conveyor. As the screw classifier conveyor moves the first solvent-wet tailings upwardly, the polar solvent flows down the inclined screw classifier conveyor and passes through the first solvent-wet tailings. The two materials mix and first solvent is displaced by the polar solvent, thereby "washing" the first solvent from the first solvent-wet tailings.

The separation of first solvent from the first solvent-wet tailings through the addition of polar solvent may also be carried out by adding polar solvent to first solvent-wet tailings loaded in a vertical column. The polar solvent may generally be added to the first solvent-wet tailings at the top end of the vertical column such that the polar solvent flows downwardly through the first solvent-wet tailings. First solvent is displaced from the first solvent-wet tailings during this process and exits the vertical column at the bottom end of the vertical column.

Any of the above processes for adding polar solvent to the first solvent-wet tailings may be performed multiple times. That is to say, multiple quantities of polar solvent may be added to the first solvent-wet tailings. For example, the countercurrent process may include multiple stages as described in greater detail above with respect to washing the first mixture. In a multiple stage countercurrent process, the polar solvent displaces progressively more first solvent after each stage and the first solvent-wet tailings lose progressively more first solvent after each stage. In a vertical column setup, a quantity of polar solvent may be added to the vertical column numerous times, and after each addition of polar solvent, a polar solvent-first solvent mixture may be collected.

Separation of first solvent from the first solvent-wet tailings by adding polar solvent may be preceded or followed by applying pressurized gas over the first solvent-wet tailings loaded in the vertical column. This may include applying a pressurized gas over the first solvent-wet tailings after the addition of each quantity of polar solvent when multiple polar solvent additions are used. Applying a pressurized gas over the first solvent-wet tailings may facilitate the separation of the first solvent component of the first solvent-wet tailings from the non-bitumen components of the first solvent-wet tailings. The liberated first solvent can either exit the vertical column as a result of the overpressure or may be shifted to a location within the first solvent-wet tailings that will allow for displacement of the first solvent upon the addition of polar solvent. Any suitable gas may be used. In some embodiments, the gas is an inert gas. In some embodiments, the gas is nitrogen, carbon dioxide, propane, or steam. The gas may also be added over first solvent-wet tailings in any suitable amount. In some embodiments, 1.8 $m^3$ to 10.6 $m^3$ of gas per ton of material comprising bitumen is used. This is equivalent to a range of about 4.5 liters to 27 liters of gas per liter of material comprising bitumen. In some embodiments, 3.5 $m^3$ of gas per ton of material comprising bitumen is used.

After polar solvent has been added to the first solvent-wet tailings and a mixture of first solvent and polar solvent has been collected, it may be desirable to separate the polar solvent from the first solvent so that both the polar solvent and the first solvent may be reused in the process. Conventional extraction methods utilizing multiple solvents typically require a distillation tower in order to separate the solvents. Such distillation towers may be costly to construct, operate, and maintain, and generally complicate the overall process. However, in the method described herein, the polar solvent-first solvent mixture may be maintained for a period of time to allow for phase separation to take place between the first solvent and the polar solvent. Such phase separation occurs without the need for any additional processing due to the presence of water in the polar solvent-first solvent mixture.

The source of the water content of the polar solvent-first solvent mixture may be the water present in the original material comprising bitumen. Bituminous material such as tar sands may naturally include from about 1 wt % to about 15 wt % water. In some embodiments, the water content of the bituminous material is not removed by the addition of the first solvent and subsequent removal of bitumen-enriched solvent phase, and thus the water content retains its presence in the first solvent-wet tailings when the polar solvent is added to displace first solvent. When polar solvent is added to the first solvent-wet tailings, the polar solvent may take up a portion or all of the water included in the first solvent-wet tailings as well as the first solvent.

The water content of the polar solvent-first solvent mixture is not limited and may vary depending on the water content of the original bitumen material. In some embodiments, the water content of the polar solvent-first solvent mixture is from about 10% to about 100% of the original water content of the material comprising bitumen (that is to say, the polar solvent captures from about 10% to about 100% of the water content in the first solvent-wet tailings as it passes through the first solvent-wet tailings to remove the first solvent). In some embodiments, the water content of the polar solvent-first solvent mixture is from about 0.5 wt % to about 25 wt % of the polar solvent-first solvent mixture The polar solvent-first solvent mixture may be maintained in any suitable fashion. In some embodiments, the polar solvent-first solvent mixture is maintained in a vessel at room temperature and pressure. However, the conditions of the surrounding area where the polar solvent-first solvent mixture is maintained may be adjusted in order to promote phase separation. For example, the humidity within the room or apparatus where the polar solvent-first solvent mixture is maintained may be adjusted so that water in the air condenses in the polar solvent-first solvent mixture. In some embodiments, the polar solvent-first solvent mixture is maintained without agitation, but agitation may be used to mix in additional components (e.g., water or additional amounts of polar or first solvent) to meet the required phase proportions prior to settling if it is deemed to promote subsequent phase separation. Agitation may be carried out according to any suitable procedures known to those of ordinary skill in the art, such as through the use of stir bar.

The polar solvent-first solvent mixture may also be maintained for any suitable period of time needed for phase separation to take place. The time period for maintaining the polar solvent-first solvent mixture may vary from seconds to hours or longer. Generally speaking, a higher water content for the polar solvent-first solvent mixture may require only a relatively short period of time of maintaining the polar solvent-first solvent mixture before phase separation occurs. As discussed above, the period of time for maintaining the polar solvent-first solvent mixture may also be affected by external conditions. Generally speaking the separation takes less than 20 minutes to complete. In a continuous extraction process, the phase separation can easily be managed as a continuous process by maintaining the interface and mixed zone at a mid-point in a separation tank and drawing off the clean phase separated solvent at the upper and lower extremities of the tank.

In some embodiments, the separation can take place "in situ". For example, in embodiments where the polar solvent is added to the first solvent-wet tailings loaded in a vertical column, the polar solvent traveling down the column may mix with and displace the first solvent phase while also picking up water contained in the first solvent-wet tailings. The change in the polar solvent/water ratio may surpass the ratio at which phase separation occurs. Upon exiting the column, two separate phases become immediately apparent: first solvent (possibly with bitumen dissolved therein) and a polar solvent/water mixture.

In some embodiments, the amount of water present in the mixture is either not sufficient to initiate the phase separation or will require a relatively long amount of time before phase separation commences. Accordingly, in some embodiments the method may further include the addition of water to the polar solvent-first solvent mixture to initiate and/or accelerate the phase separation process.

Water may be added to the polar solvent-first solvent mixture in any suitable manner. In some embodiments, the water may be added to the polar solvent-first solvent mixture in a drop-wise fashion. After each quantity of water has been added to the mixture, a period of time may be allowed to elapse during which it may be observed whether or not phase separation between the polar solvent and the first solvent has been initiated. In this manner, no more water than is necessary is added to the polar solvent-first solvent mixture, which further reduces the overall cost of performing the process.

The amount of water added to the polar solvent-first solvent mixture is not limited, and may vary based on the composition of the polar solvent-first solvent mixture. In some embodiments, the amount of water added to the mixture is from about 1% to about 10% of the amount of polar solvent present in the polar solvent-first solvent mixture.

In addition to adding water to the polar solvent-first solvent mixture, water may be added during other stages of the method so as to ultimately provide the polar solvent-first solvent mixture with the water content needed to initiate separation. For example, water can be added to the first mixture prior to the addition of first solvent or polar solvent. In this manner, more water is present in the first solvent-wet tailings when polar solvent is added, which may then be taken up by the polar solvent as discussed in greater detail above. The additional water taken up by the polar solvent may result in the polar solvent-first solvent mixture having sufficient water content to initiate separation with the need for adding water directly the polar solvent-first solvent mixture. In a similar manner, water may be added to the material comprising bitumen before mixing the material comprising bitumen with first solvent 100, or may be added to the polar solvent prior to adding the polar solvent to the first solvent-wet tailings. Water can also be added in the form of steam. For example, adding steam to the first mixture may provide the first mixture with additional water content while also lowering the viscosity and increasing the temperature of the first mixture.

Additional components may be added to the water in order to further enhance water's phase separation effect on the polar solvent-first solvent mixture. The type of component added to the water may be any suitable component for further promoting phase separation. Exemplary components include, but are not limited to, surfactants and ionizable components (e.g., salts, bases and acids).

It should be noted that the phase separation between the polar solvent and the first solvent may be affected by the presence of dissolved bitumen in the first solvent. Typically, only a minor amount of bitumen is present in the first solvent as a majority of the bitumen-enriched solvent phase has been removed through the first stages of separation with a first solvent. However, in some cases, the presence of bitumen in the polar solvent-first solvent mixture may require that more water be present in the mixture or added to the mixture before phase separation will take place.

Phase separation, whether through the addition of water or from the original water content of the material comprising bitumen, may generally result in the polar solvent collecting in a layer on top of the first solvent. Further processing may take place in order to separate the first solvent phase from the polar solvent phase. The separation of one phase from another phase after phase separation has occurred may be carried out by any suitable method. In some embodiments, a decanting step may be carried out to remove the top layer of polar solvent phase from the lower layer of first solvent. The decanting process may generally include pouring the polar solvent phase top layer out of the vessel in which the polar solvent-first solvent mixture was maintained during phase separation and terminating the pouring action prior to any of the first solvent phase lower layer exiting the vessel. Another example of a process for separating the first solvent phase from the polar solvent/water phase may include skimming the polar solvent phase top layer off the first solvent phase lower layer.

The polar solvent phase remaining after the separation of the first solvent phase may include a water content due to the miscibility of the polar solvent with water. Accordingly, the method may also include separating the water from the polar solvent phase. This may be carried out according to any suitable method known to those of ordinary skill in the art, including heating the polar solvent phase to a temperature above the boiling point temperature of polar solvent and below the boiling point temperature of water. Such processing may result in the evaporation of the polar solvent while the water remains in a liquid state. The evaporated polar solvent may then be condensed back into a liquid and collected for reuse in the method.

Separation of the polar solvent and first solvent may be useful so that the polar solvent and first solvent may be reused, including reusing the first solvent and the polar solvent in further extraction of bitumen according to the method described herein. When the polar solvent and first solvent are separated, the first solvent may be recycled back to mixing first solvent with material comprising bitumen 100 or separating bitumen-enriched solvent phase from the first mixture 110, and the polar solvent may be recycled back to adding polar solvent to the first solvent-wet tailings 120 in order to displace first solvent. Enough first solvent may be recovered from the separation of the polar solvent and the first solvent that only a minimal amount of make-up first solvent is required.

The method as described above may also include further steps for processing the polar solvent-wet tailings resulting from the addition of polar solvent to the first solvent-wet tailings. More specifically, additional processing may occur to remove the polar solvent from the polar solvent-wet tailings and thereby create solvent-dry tailings. In some embodiments, this further processing includes the use of a tailings solvent recovery unit (TSRU) that removes the solvent from the tailings. The type of TSRU suitable for removing the polar solvent from the polar solvent-wet tailings is not limited. In one example, the TSRU may be a heater that heats the polar solvent-wet tailings to a temperature above the boiling point of the polar solvent in order to evaporate the polar solvent from the tailings. The polar solvent may then be condensed and collected for reuse in bitumen extraction method.

The solvent-dry tailings resulting from removal of the polar solvent from the polar solvent-wet tailings generally include inorganic solids, such as sand and clay, water, and little to no first and second solvent. As used herein, the term "solvent-dry" means containing less than 0.1 wt % total solvent. In some embodiments, the tailings may include a water content of from about 2 wt % to about 15 wt %. This range of water content creates a damp tailings that will not produce dust when transporting or depositing the tailings. This range of water content also provides a stackable tailings that will not flow like dry sand, and therefore has the ability to be retained within an area without the need for retaining structures (e.g., a tailings pond). This range of water content also provides tailings that are not so wet as to be sludge-like or liquid-like.

Figure 2:
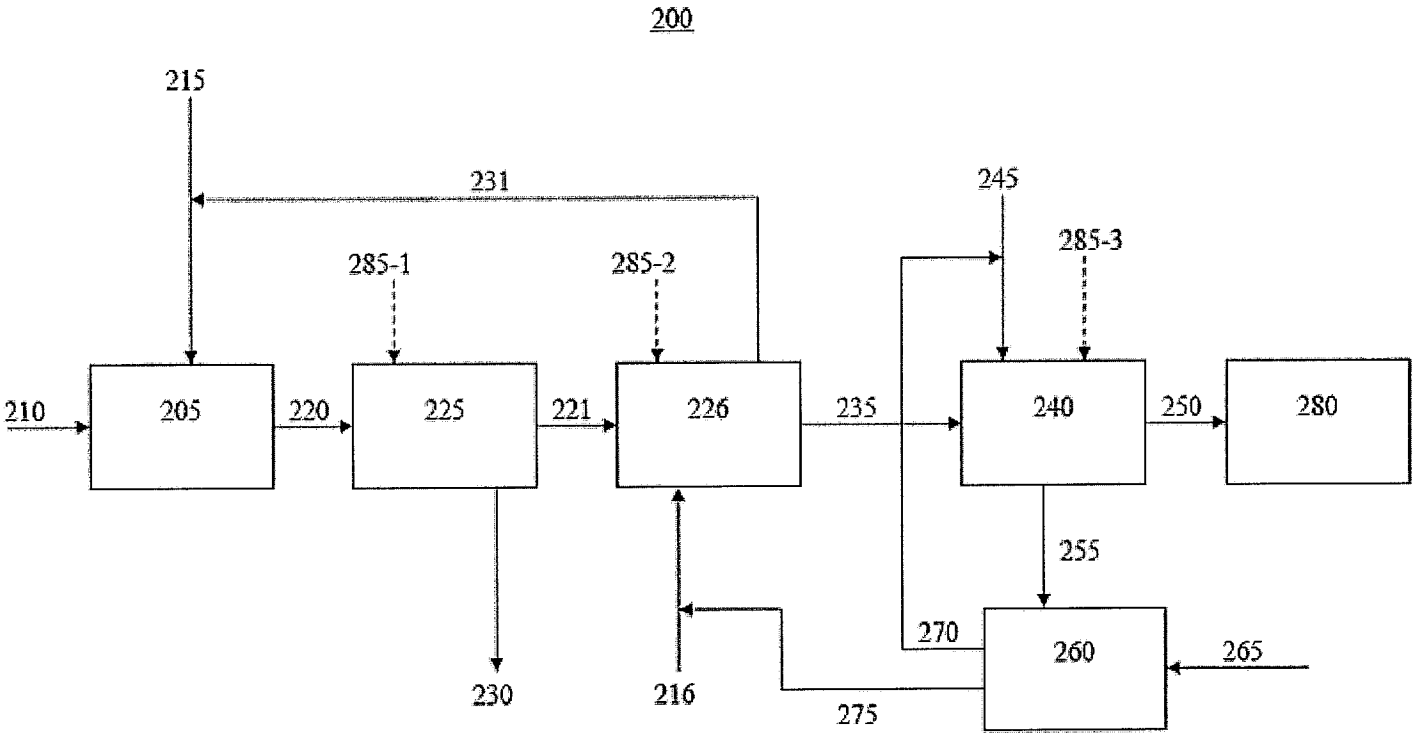
FIG. 2 is a schematic diagram for a system and method for obtaining bituminous materials as disclosed herein.

With reference to FIG. 2, a system 200 for carrying out the above-described method may include a mixer 205 for mixing material comprising bitumen 210 and first solvent 215. Any suitable mixing vessel may be used, including a mixing vessel that operates under pressure in order to maintain the first solvent as a liquid. A first mixture 220 is formed by the mixing of the material comprising bitumen 210 and the first solvent 215 in the mixer 205.

The first mixture 220 is transported to a first separation unit 225 where a gas overpressure 285-1 is applied to separate bitumen-enriched solvent phase 230 from the first mixture. The bitumen-enriched solvent phase 230 separated may be free bitumen-enriched solvent phase entrained in the first mixture, and the gas used in the gas overpressure 285-1 may be nitrogen. While not shown in FIG. 2, bitumen-enriched solvent phase 230 may be subjected to a separation unit in order to separate first solvent from bitumen, and the separated bitumen may be use in conjunction with or in place of first solvent 216.

After bitumen-enriched solvent phase 230 is separated, the first mixture 221 may be transported to a second separation unit 226 where first solvent 216 is added to the first mixture 221 to displace further bitumen-enriched solvent phase 231 from the first mixture 221. Any separation unit suitable for separating the bitumen-enriched solvent phase 231 from the first mixture 221 may be used. In some embodiments, second separation unit 226 is a plate and frame filter press. Pressurized gas 285-2 may be pumped into the second separation unit 226 to promote separation of bitumen from the non-bitumen components of the material comprising bitumen. When pressurized gas 285-2 is pumped into second separation unit 226, the spent gas may also exit the second separation unit 226 with the bitumen-enriched solvent phase 231. Because the gas does not dissolve in either the bitumen or the first solvent of the first mixture 221, the gas exits with the bitumen-enriched solvent phase 231. The gas may either be vented (after being cleaned of solvent) or may be separated from the liquid phase and recompressed for reuse (in which case no clean up of solvent is required). Removal of the bitumen-enriched solvent phase 231 from the first mixture 221 via second separation unit 226 results in the first mixture 221 becoming first solvent-wet tailings 235. Bitumen-enriched solvent phase 231 may be recycled back to mixing unit 205 for mixing with further material comprising bitumen 210. Bitumen-enriched solvent phase 231 may be used in conjunction with or in place of first solvent 215

The first solvent-wet tailings 235 produced by the second separation unit 226 are transported to a third separation unit 240 where polar solvent 245 is added to the first solvent-wet tailings 235 in order to separate first solvent from the first solvent-wet tailings 235. Any separation unit suitable for separating the first solvent from the first solvent wet tailings 235 may be used. In some embodiments, third separation unit 240 is a plate and frame filter press. First solvent may be separated from the first solvent-wet tailings 235 as part of a polar solvent-first solvent mixture 255. Pressurized gas 285-3 may be pumped into the third separation unit 240 to promote separation of the first solvent from the non-bitumen components of the first solvent-wet tailings 235. When pressurized gas 285-3 is pumped into third separation unit 240, the spent gas may also exit the third separation unit 240 with the polar solvent-first solvent mixture 255. The gas may either be vented (after being cleaned of solvent) or may be separated from the liquid phase and recompressed for reuse (in which case no clean up of solvent is required). Separation of the first solvent from the first solvent-wet tailings 235 results in the first solvent-wet tailings 235 becoming polar solvent-wet tailings 250. The polar solvent-wet tailings 250 may be transported to a tailings solvent recovery unit 280 to remove the polar solvent and produce solvent-dry tailings. Polar solvent removed in tailings solvent recovery unit 280 may be recycled back to third separation unit, such as by adding the polar solvent with polar solvent 245 or replacing polar solvent 245.

The polar solvent-first solvent mixture 255 is transported to a phase disengagement unit 260. The phase disengagement unit 260 may provide an area for the polar solvent-first solvent mixture 255 to be maintained for a period of time to allow for phase separation to occur due to the water content of the polar solvent-first solvent mixture 255. Water 265 may optionally be added to the polar solvent-first solvent mixture 255 at the phase disengagement unit 260 in order to promote phase disengagement between the polar solvent and the first solvent of the polar solvent-first solvent mixture 255. While not shown in FIG. 2, water may also be added to the first solvent-wet tailings 235 in the third separation unit 240 prior to adding polar solvent 245. This water will then be carried with the polar solvent to the polar solvent-first solvent mixture 255 to help promote phase separation. Once phase disengagement has been completed, further processing (such as decanting) may take place to separate the first solvent 275 and the polar solvent 270. Polar solvent 270 may then be recycled back to third separation unit 240, such as by adding the polar solvent 270 with the polar solvent 245 prior to adding the polar solvent 245 to the first solvent-wet tailings 235. Polar solvent 270 may have a water balance issue requiring a purge to remove water from the process, depending on how much water exits with the solvent dry tailings produced by tailings solvent recovery unit 280. First solvent 275 may be recycled back to second separation unit 226, such as by adding the first solvent 275 with the first solvent 216 prior to adding the first solvent 216 to the first mixture 221. Although not shown in FIG. 2, first solvent 275 may also be recycled back to mixer 205.

While FIG. 2 depicts separate units for mixer 205, first separation unit 225, second separation unit 226, and third separation unit 240, one or more of these units could be combined together into a single unit. For example, mixer 205, first separation unit 225, second separation unit 226, and third separation unit 240 could also be combined into a single unit.

EXAMPLES

Example 1

14.4 kg of Athabasaca oil sand containing about 12.2% or 1.76 kg of bitumen was disaggregated with 1.8 kg of Solvesso 150 in a spiral classifier type of a device. This amounted to a solvent-to-bitumen volume ratio of about 1.14.

This material was charged to a laboratory pressure filter and another charge of Solvesso 150 (1.5 kg) was added on top of the disaggregated material. A 10 psi nitrogen over pressure was applied for about 10 minutes. 3.25 kg of bitumen-enriched solvent phase was produced as a liquid product. About 1.46 kg of solvent phase was retained in the filter cake giving it a solvent phase content of about 11 wt %. The total Solvesso 150 solvent-to-bitumen volume ratio amounted to about 2.1.

1.5 kg of methanol was added to the filter cake to displace the solvent phase (having a minor bitumen content). The mixture of methanol and solvent removed from the filter cake was not analyzed. The final filter cake was dried to remove methanol and had a dry weight of 12.1 kg with a final bitumen content of 1.9%, giving an overall bitumen recovery of about 87%.

Example 2

The deportment of the bitumen in the dried filter cake of Example 1 was investigated by screening the 12.1 kg of dried filter cake on 1/4 inch screen, giving an over size of 1,704 grams and an under size of 10,391 grams. This undersize assayed about 1.7% bitumen and the over size had a combined 3.3% bitumen.

The particles of the over sized fraction were classified as follows:

| Total Tails | Mass gram | Mass % | Bitumen % Grade | Bitumen % Recovery |
|---|---|---|---|---|
| Details −¼" undersize | 10391 | 85.9 | 1.7 | 10.0 |
| Details +¼" oversize | | | | |
| Normal tar balls | 353 | 2.9 | 7.1 | 1.4 |
| Intercalated with clay | 602 | 5.0 | 4.5 | 1.6 |
| Rocks (quartzite, shale) | 446 | 3.7 | n/a | — |
| Clay (apparently barren) | 241 | 2.0 | 1.9 | 0.3 |
| Coal-like anthracitic material | 62 | 0.5 | n/a | — |
| Total +¼" | 1704 | 14.1 | 3.3 | 3.2 |

This table demonstrates that most of the unrecovered bitumen was present in the −¼ inch under size material.

Example 3

600 kg of Athabasca oil sand containing about 12.5% bitumen was mixed in a drum roller device with 65.5 kg of Solvesso 150 solvent. The total mixture was charged to a 22 inch diameter 6-ft tall fiberglass column. The column was pressurized with about 30 psig nitrogen and 73 kg of bitumen-enriched solvent phase was drained from an approximately 5 ft thick filter cake. 124 kg of virgin Solvesso 150 was added as a wash solution to the top of the column and nitrogen over pressure resulted in the production of 69.5 kg of wash bitumen-enriched solvent phase. This was then followed up with a 58.4 kg of methanol wash solvent to displace the wash solvent phase still entrained in between the particles in the column. 54.2 kg of filtrate containing some bitumen, Solvesso 150 and methanol was obtained.

The final 520 kg of sand tailings contained 0.4 kg of bitumen plus 45 kg of residual wash solvent. Overall bitumen recovery from the initial oil sand to the final tails amounted to 99.4%.

Example 4

The behavior of water in an aromatic solvent-alcohol system was investigated. Solvesso 150 was selected as the aromatic organic phase and methanol was selected as the alcohol. Five aliquots of 250 cc total organic liquid were prepared each containing different volume percentages of Solvesso 150 and methanol.

| Initial volume cc | Solvesso vol-% | Methanol vol-% | Water addition needed for organic separation cc | Calculated water in methanol vol % |
|---|---|---|---|---|
| 250 | 90 | 10 | 1.5 | 6 |
| 250 | 75 | 25 | 1.5 | 2.4 |
| 250 | 50 | 50 | 10 | 8 |
| 250 | 50* | 50 | 15 | 12 |
| 250 | 25 | 75 | 15 | 8 |
| 250 | 10 | 90 | 5 | 2.2 |

*Solvesso was replaced by a light aromatic distillate (~200 deg C.)

When the two organic phases were initially mixed, all five sample phases were totally miscible and no separation of phases occurred. Then water was added to each sample and the required volume of water needed to produce an immiscible system was measured. It should be noted that the water phase completely dissolved into the methanol phase. Hence only two phases were noticed. This experiment confirmed that water acts as an antisolvent or a "salting out" agent for a mixed aromatic-alcohol system.

One test was carried out using a light distillate that was derived from a hydrocarbon cracking process as defined in U.S. patent application Ser. No. 12/509,298. Since methanol has a lower density (~0.8 g/cc) then Solvesso (~0.9 g/cc), it will separate as the top layer whereas Solvesso will settle down as the bottom layer.

Two other findings were made. Firstly, if more than the minimum amount of water necessary to separate the aromatic-alcohol system is added, the density of the methanol/water phase increases until it ultimately reaches a density that is higher than the Solvesso phase. As a result, an inversion takes place. Secondly, the test procedures also demonstrated that if any Solvesso-methanol miscible mixture that was left standing for enough time and exposed to the air, the mixture became unstable due to the absorption of moisture from the air. Brownian movements of separated phases in the miscible phase were clearly visible.

First solvent-wet tailings that have undergone bitumen-enriched solvent phase separation through the addition of solvent may include about 12% first solvent (e.g., Solvesso 150, which may include minor amounts of bitumen dissolved therein). The volume ratio of first solvent to polar solvent used to wash first solvent-wet tailings of first solvent can range from about 1 to as much as 4. Athabasca tar sands have a moisture content ranging from about 2 to 10 wt-%. Hence for every kg of tar sands added to the process, there will be between 20 and 100 grams of water. Every kg of tar sand will produce a first solvent-wet tailings containing about 120 grams of first solvent. Therefore, the amount of polar solvent used for each kg of tar sand ranges 120 to 480 ccs of polar solvent. To produce immiscible phases of first solvent and polar solvent, one requires at least 8 vol-% of water in methanol as shown in the Table above. This translates into 9.6 to 38.4 grams of water per kg of tar sand. This range should be compared to the water content originally present in tar sands (ranging from 20 to 100 gram per kg tar sand). Thus, on average the tar sand itself should provide most of the water necessary to facilitate the phase disengagement between the first solvent and the polar solvent.

The above conditions were calculated for the overall process configuration, but it should be realized that the initial flow of polar solvent will not have access to the full amount of available water that should be present in the first solvent-wet tailings. Consequently, as the polar solvent is contacted with the first solvent wet tailings, there will be a gradual increase in the water to polar solvent ratio and there will therefore be a change in the miscibility as the polar solvent travels through the first solvent wet tailings.

Example 5

40 kg of Athabasca oil sands containing about 12.1% bitumen were mixed for 15 minutes with 2.2 kg of virgin Solvesso 150 solvent and 4.4 kg of bitumen-enriched solvent phase obtained from previous separation of bitumen-enriched solvent phase from a mixture of oil sands and Solvesso 150. The bitumen-enriched solvent phase included about 55 wt-% bitumen and 45 wt-% Solvesso 150. The total weight of 46.6 kg mixture was charged to a 6 inch diameter, 6 feet tall steel column. Nitrogen at a pressure of about 20 psig was applied to drain about 6.0 kg of bitumen-enriched solvent phase from the column. A further batch of 4.4 kg Solvesso 150 solvent was added to the top of the column. Over a period of about 15 minutes, 6.5 kg of wash bitumen-enriched solvent phase was obtained. Methanol as the polar wash solvent was then charged in five separate stages (each 1.3 kg) to the column. Each stage was followed by a nitrogen purge. A total of 7.3 kg of solvent phase liquid was collected, with each separate stage amounting to 1.2 kg, 1.2 kg, 1.4 kg, 1.1 kg, and 2.5 kg respectively.

The final product was analyzed for bitumen and contained 0.54% residual bitumen, representing a recovery of around 96%.

Example 6

600 kg of Athabasca oil sands containing 72.6 kg of bitumen together with about 66 kg of Solvesso 150 was loaded into a Falk mill and mixed for about 15 minutes. The mixture was charged to a 22 inch diameter, 6 feet tall column. A 20 psig nitrogen over pressure was applied and 73 kg of bitumen-enriched solvent phase (containing about equal weights of Solvesso and bitumen) was collected. 66 kg of Solvesso wash solvent was injected into the column to remove the residual bitumen-enriched solvent phase. A 20 psig nitrogen over pressure was then applied. 69.5 kg of wash bitumen-enriched solvent phase was collected that contained about 65 wt-% Solvesso and 35% wt-% bitumen. About 58 kg of methanol was charged as the second wash solution to the column, a 20 psig nitrogen over pressure was applied, and 54.2 kg of solvent phase was collected. The residual solvent in the tails was analyzed at 9.2%, which included a residual bitumen content of only 0.1%. This represents a bitumen recovery in excess of 99%.

Example 7

Figure 3:
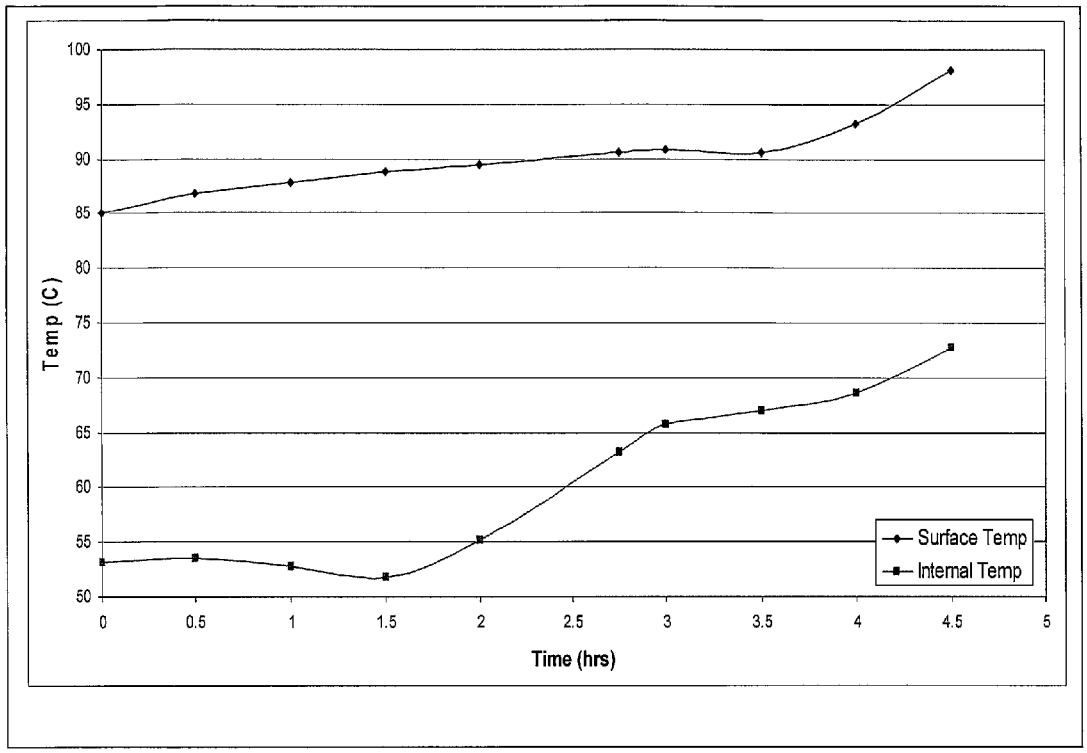
FIG. 3 is a graph illustrating the internal temperature and surface temperature of a vertical column during heating of the vertical column to remove methanol from the material loaded in the vertical column.

The removal of polar solvent from a vertical column was investigated. A six inch diameter, 6 feet tall column was equipped with a heating device consisting of half inch copper tubing connected to an in-line heater and wrapped around the exterior of the vertical column. The vertical column was charged with the spent sand having a methanol content from Example 3 was used The in-line heater was set to a temperature of 95° C. A thermocouple probe was inserted in the middle of the material loaded in the vertical column to record the internal temperature and a vacuum was applied to the column. The evaporated gas passed through a condenser to collect any methanol vapors. The column was heated for a period of 4.5 hours. A graph of the internal and external temperatures can be seen in FIG. 3. After about 2.8 hours, the boiling point of methanol (64.7 deg C.) was exceeded.

The methanol remaining in the spent sand after heating was analyzed at 85 ppm. It was determined that 94% of the methanol originally present in the spent sand was recovered in the condenser. The final bitumen content in the spent sand was determined to be 1400 ppm or 0.14%, providing a bitumen recovery of around 99%. Based on an estimated 100 ppm of residual Solvesso 150 plus an assayed 85 ppm methanol, the final tailing stream contained about 235 vol-pmm solvent. The tailings stream will therefore fully meet local government solvent-in-oil-sands-tails specification (estimated at a maximum value equivalent to about 480 vol-ppm).

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method comprising:

mixing a material comprising bitumen with a first quantity of first solvent to form a first mixture, wherein the first mixture comprises a bitumen-enriched solvent phase;

separating bitumen-enriched solvent phase from the first mixture to produce first solvent-wet tailings, wherein the first solvent-wet tailings comprise a first solvent component;

adding a polar solvent to the first solvent-wet tailings to separate first solvent component from the first solvent-wet tailings and produce polar solvent-wet tailings, wherein the first solvent component is separated from the first solvent-wet tailings as part of a polar solvent-first solvent mixture, wherein the polar solvent comprises an oxygenated hydrocarbon; and maintaining the polar solvent-first solvent mixture for a period of time to allow the polar solvent-first mixture to phase separate into a polar solvent phase and a first solvent phase.

2. The method of claim 1, further comprising:

separating the polar solvent phase from the first solvent phase.

3. The method as recited in claim 2, wherein the polar solvent phase is added to further first solvent-wet tailings.

4. The method as recited in claim 1, wherein separating bitumen-enriched solvent phase from the first mixture comprises:

filtering or settling the first mixture to separate a first quantity of the bitumen-enriched solvent phase from the first mixture; and adding a second quantity of first solvent to the first mixture to separate a second quantity of the bitumen-enriched solvent phase from the first mixture.

5. The method as recited in claim 4, wherein adding a second quantity of first solvent to the first mixture comprises washing the first mixture with the second quantity of first solvent in a countercurrent process.

6. The method as recited in claim 4, wherein adding the second quantity of first solvent to the first mixture comprises adding the second quantity of first solvent to the first mixture loaded in a plate and frame-type filter press.

7. The method as recited in claim 6, wherein adding the second quantity of first solvent to the first mixture further comprises adding a pressurized gas over the first mixture loaded in the plate and frame-type filter press.

8. The method as recited in claim 1, wherein adding the polar solvent to the first solvent-wet tailings comprises washing the first solvent-wet tailings with the polar solvent in a countercurrent process.

9. The method as recited in claim 1, wherein the first solvent comprises a light aromatic solvent.

10. The method as recited in claim 1, wherein adding the polar solvent to the first solvent-wet tailings comprises adding the polar solvent to the first solvent-wet tailings loaded in a plate and frame-type filter press.

11. The method as recited in claim 10, wherein adding the polar solvent to the first solvent-wet tailings further comprises adding a pressurized gas over the first solvent-wet tailings loaded in the plate and frame-type filter press.

12. The method as recited in claim 1, wherein the material comprising bitumen comprises tar sands.

13. The method as recited in claim 1, wherein separating bitumen-enriched solvent phase from the first mixture comprises:

loading the first mixture in a vertical column having a top end and a bottom end;

adding a second quantity of first solvent into the first mixture loaded in the vertical column at the top end of the vertical column; and collecting a first quantity of the bitumen-enriched solvent phase at the bottom end of the vertical column.

14. The method as recited in claim 13, further comprising:

adding a third quantity of first solvent into the first mixture loaded in the vertical column at the top end of the vertical column; and collecting a second quantity of the bitumen-enriched solvent phase at the bottom end of the vertical column.

15. The method as recited in claim 13, wherein the first solvent-wet tailings are discharged from the vertical column prior to adding the polar solvent to the first solvent-wet tailings.

16. The method as recited in claim 15, further comprising:

injecting a heated gas into the polar solvent-wet tailings to separate polar solvent from the polar solvent-wet tailings loaded in the vertical column.

17. The method as recited in claim 13, wherein adding the polar solvent to the first solvent-wet tailings comprises:

adding a first quantity of the polar solvent into the first solvent-wet tailings loaded in the vertical column; and collecting a first quantity of the polar solvent-first solvent mixture at the bottom end of the vertical column.

18. The method as recited in claim 17, further comprising:

adding a second quantity of the polar solvent into the first solvent-wet tailings loaded in the vertical column; and collecting a second quantity of the polar solvent-first solvent mixture at the bottom end of the vertical column.

19. The method as recited in claim 17, further comprising adding a pressurized gas over the first solvent-wet tailings loaded in the vertical column prior to or after adding the first quantity of the polar solvent into the first solvent-wet tailings loaded in the vertical column.

20. The method as recited in claim 1, wherein the bitumen-enriched solvent phase comprises a bitumen component and further comprising upgrading the bitumen component.

21. The method as recited in claim 1, wherein the oxygenated hydrocarbon comprises ethanol, methanol, butanol, isopropyl alcohol or tert-butyl alcohol.

22. The method as recited in claim 1, wherein the oxygenated hydrocarbon is an alcohol, ketone, or ether.

23. A method comprising:

mixing a material comprising bitumen with a first quantity of first solvent to form a first mixture, wherein the first mixture comprises a bitumen-enriched solvent phase;

separating bitumen-enriched solvent phase from the first mixture to produce first solvent-wet tailings, wherein the first solvent-wet tailings comprise a first solvent component;

adding a polar solvent to the first solvent-wet tailings to separate first solvent component from the first solvent-wet tailings and produce polar solvent-wet tailings, wherein the first solvent component is separated from the first solvent-wet tailings as part of a polar solvent-first solvent mixture;

maintaining the polar solvent-first solvent mixture for a period of time to allow the polar solvent-first mixture to phase separate into a polar solvent phase and a first solvent phase; and adding a first quantity of water to the polar solvent-first solvent mixture.

24. A method comprising:

mixing a material comprising bitumen with a first quantity of first solvent to form a first mixture, wherein the first mixture comprises a bitumen-enriched solvent phase;

separating bitumen-enriched solvent phase from the first mixture to produce first solvent-wet tailings, wherein the first solvent-wet tailings comprise a first solvent component;

adding a polar solvent to the first solvent-wet tailings to separate first solvent component from the first solvent-wet tailings and produce polar solvent-wet tailings, wherein the first solvent component is separated from the first solvent-wet tailings as part of a polar solvent-first solvent mixture; and maintaining the polar solvent-first solvent mixture for a period of time to allow the polar solvent-first mixture to phase separate into a polar solvent phase and a first solvent phase;

wherein separating polar solvent from the polar solvent-wet tailings comprises heating the polar solvent-wet tailings to a temperature above the boiling point temperature of the polar solvent.

25. The method as recited in claim 24, wherein the light aromatic solvent comprises kerosene, diesel, gas oil, naphtha, benzene, toluene, an aromatic alcohol, derivatives thereof, or a combination thereof.

26. A method comprising:

mixing a material comprising bitumen with a first quantity of first solvent;

separating a bitumen-enriched solvent phase from a first result of mixing the material comprising bitumen with the first quantity of first solvent;

adding a polar solvent to a second result of separating bitumen-enriched solvent phase from the first result;

maintaining a third result of adding a polar solvent to the second result for a period of time; and adding a first quantity of water to the third result.

27. The method as recited in claim 26, wherein separating the bitumen-enriched solvent phase from the first result of mixing the material comprising bitumen with the first quantity of first solvent comprises adding first solvent to the first result.

28. The method as recited in claim 27, wherein the first solvent comprises a light aromatic solvent.

29. The method as recited in claim 28, wherein the light aromatic solvent comprises kerosene, diesel, gas oil, naphtha, benzene, toluene, an aromatic alcohol, derivatives thereof, or a combination thereof.

30. The method as recited in claim 26, wherein the polar solvent comprises methanol, ethanol, propanol or butanol.

31. A method comprising:

i) mixing a material comprising bitumen with a first quantity of first solvent to form a first mixture, wherein the first mixture comprises bitumen-enriched solvent phase;

ii) adding a pressurized gas over the first mixture to separate a first quantity of bitumen-enriched solvent phase from the first mixture;

iii) adding a second quantity of bitumen-enriched solvent phase to the first mixture to separate a second quantity of bitumen-enriched solvent phase from the first mixture and produce first solvent-wet tailings, wherein the first solvent-wet tailings comprise a first solvent component;

iv) adding a first quantity of polar solvent to the first solvent-wet tailings to separate a first quantity of first solvent component from the first solvent-wet tailings, wherein the first quantity of first solvent component is separated from the first solvent-wet tailings as part of a polar solvent-first solvent mixture, wherein the polar solvent comprises an oxygenated hydrocarbon;

v) adding a pressurized gas over the first solvent-wet tailings; and vi) maintaining the polar solvent-first solvent mixture for a period of time to allow the polar solvent-first mixture to phase separate into a polar solvent phase and a first solvent phase.

32. The method as recited in claim 31, wherein iii) is repeated one or more times.

33. The method as recited in claim 31, wherein iv) and v) are repeated one or more times.

34. A method comprising:

mixing a material comprising bitumen with a first quantity of first solvent to form a first mixture, wherein the first mixture comprises a bitumen-enriched solvent phase;

separating bitumen-enriched solvent phase from the first mixture to produce first solvent-wet tailings, wherein the first solvent-wet tailings comprise a first solvent component; and adding a polar solvent to the first solvent-wet tailings to separate first solvent component from the first solvent-wet tailings and produce polar solvent-wet tailings, wherein the first solvent component is separated from the first solvent-wet tailings as a separated phase of a phase separated polar solvent-first solvent mixture, wherein the polar solvent comprises an oxygenated hydrocarbon.

* * * * *